US007915832B2

(12) United States Patent
Arai et al.

(10) Patent No.: US 7,915,832 B2
(45) Date of Patent: Mar. 29, 2011

(54) PLASMA DISPLAY PANEL DRIVE CIRCUIT AND PLASMA DISPLAY APPARATUS

(75) Inventors: Yasuhiro Arai, Osaka (JP); Hideki Nakata, Osaka (JP); Toshikazu Nagaki, Osaka (JP); Satoshi Ikeda, Osaka (JP)

(73) Assignee: PANASONIC Corporation, Osaka (JP)

( * ) Notice: Subject to any disclaimer, the term of this patent is extended or adjusted under 35 U.S.C. 154(b) by 261 days.

(21) Appl. No.: 11/817,354

(22) PCT Filed: Feb. 8, 2006

(86) PCT No.: PCT/JP2006/302580

§ 371 (c)(1),
(2), (4) Date: Aug. 29, 2007

(87) PCT Pub. No.: WO2006/126314

PCT Pub. Date: Nov. 30, 2006

(65) Prior Publication Data

US 2009/0058310 A1 Mar. 5, 2009

(30) Foreign Application Priority Data

May 23, 2005 (JP) ..... 2005-149045

(51) Int. Cl.
*G09G 3/10* (2006.01)

(52) U.S. Cl. ..... 315/169.4; 315/172; 315/209 R

(58) Field of Classification Search ..... 315/169.4, 315/169.1, 160, 406, 84.61, 167, 169.2, 170, 315/172, 174, 209 R, 224, 225, 246, 291; 345/30, 33, 36, 37, 43, 45, 52, 53
See application file for complete search history.

(56) References Cited

U.S. PATENT DOCUMENTS

| | | | |
|---|---|---|---|
| 4,866,349 | A | 9/1989 | Weber et al. |
| 6,567,059 | B1 | 5/2003 | Ide et al. |
| 6,628,087 | B2 | 9/2003 | Roh et al. |
| 2002/0033675 | A1 | 3/2002 | Kang et al. |
| 2003/0057851 | A1 | 3/2003 | Roh et al. |

(Continued)

FOREIGN PATENT DOCUMENTS

| | | |
|---|---|---|
| EP | 0261584 | 3/1988 |

(Continued)

OTHER PUBLICATIONS

English Language Abstract of JP 63-101897.

(Continued)

*Primary Examiner* — Douglas W Owens
*Assistant Examiner* — Jianzi Chen
(74) *Attorney, Agent, or Firm* — Greenblum & Bernstein, P.L.C.

(57) ABSTRACT

A drive circuit for driving a plasma display panel (PDP) includes a pulse voltage generator that contains main switching elements disposed on a high voltage side and on a low voltage side, is operable to generate a pulse voltage by operating the main switching elements in accordance with an output voltage from a first power supply and apply the pulse voltage to a PDP scan electrode and sustain electrode, and a reset voltage generator operable to generate a reset voltage in accordance with an output voltage from a second power supply and apply it to the PDP. The pulse voltage generator contains a first diode that prevents the voltage output by the reset voltage generator from being applied backward to the first power supply and a first switching element connected to the first diode in parallel.

20 Claims, 25 Drawing Sheets

U.S. PATENT DOCUMENTS

| | | | | |
|---|---|---|---|---|
| 2005/0057453 | A1 | 3/2005 | Lee et al. | |
| 2005/0168406 | A1 * | 8/2005 | Lee et al. | 345/60 |
| 2005/0231440 | A1 * | 10/2005 | Inoue et al. | 345/60 |
| 2006/0038750 | A1 | 2/2006 | Inoue et al. | |
| 2006/0103605 | A1 | 5/2006 | Choi | |

FOREIGN PATENT DOCUMENTS

| | | |
|---|---|---|
| EP | 1172794 | 1/2002 |
| EP | 1324299 | 7/2003 |
| JP | 7 109542 | 11/1995 |
| JP | 2000 293135 | 10/2000 |
| JP | 2003 15600 | 1/2003 |
| JP | 2004 13168 | 1/2004 |
| JP | 2005 70787 | 3/2005 |

OTHER PUBLICATIONS

English Language Abstract of JP 2005-70787.
English Language Abstract of JP 2003-15600.
English Language Abstract of JP 2000-293135.
English Language Abstract of JP 2004-13168.

* cited by examiner

PLASMA DISPLAY PANEL DRIVE CIRCUIT AND PLASMA DISPLAY APPARATUS

TECHNICAL FIELD

The present invention relates to a plasma display panel drive circuit, as well as plasma display apparatus, used for wall-mounted TV sets and large-size monitors.

BACKGROUND ART

An AC surface discharge type plasma display panel (hereinafter called "PDP") which is typical as the AC type is constituted by arranging a front plate containing a glass substrate formed by disposing a scan electrode and a sustain electrode which carry out surface discharge and a back plate containing a glass substrate formed by disposing data electrodes oppositely in parallel so that both electrodes set up a matrix and a discharge space is formed in a gap, and by sealing the perimeter portion with sealing materials such as glass frit, etc. Between both substrates of the front plate and the back plate, discharge cells divided by bulkheads are provided, and in a cell space between these bulkheads, a phosphor layer is formed. In PDP of such configuration, ultraviolet rays are generated by gas discharge, and with this ultraviolet ray, phosphors of each color of red (R), green (G) and blue (B) are excited to emit light, thereby achieving color display.

In this kind of plasma display apparatus, various electric power reduction techniques are proposed to reduce the electric power consumption.

As one of the techniques to reduce electric power consumption, there disclosed is a so-called power recovery circuit, in consideration to the fact that PDP is a capacitive load. By the power recovery circuit, the inductor and PDP capacitive load are LC-resonated by a resonance circuit in which an inductor is included as a component element, the electric power accumulated in the PDP capacitive load is recovered to a capacitor for electric power recovery, and the recovered electric power is reused for driving PDP (see, for example, patent document 1).

In this technique, for example, the electric power recovered from PDP is reused for applying sustain pulse voltage to the scan electrode and the sustain electrode in a sustain period to reduce the electric power consumed during the sustain period, and thereby reduction of electric power consumption can be achieved.

That is, in the sustain pulse generation circuit, a resonance circuit equipped with an inductor, that is, an electric recovery circuit is installed. By this, electric power accumulated in the PDP capacitive load (capacitive load generated in the scan electrode) is recovered, the recovered electric power is reused as driving electric power of the scan electrode, and electric power consumption is reduced. In addition, in the sustain pulse generation circuit, a power recovery circuit is installed. By this, electric power accumulated in PDP capacitive load (capacitive load generated in the sustain electrode) is recovered, and the recovered electric power is reused as driving power of the sustain electrode and electric power consumption is reduced.

FIG. 25 is a circuit diagram of a scan electrode drive circuit and sustain electrode drive circuit equipped with such a power recovery circuit. In the figure, a scan electrode drive circuit 5 includes a sustain pulse generation circuit 51, a reset waveform generation circuit 52, and a scan pulse generation circuit 53.

The sustain pulse generation circuit 51 includes a power recovery circuit which has a coil L1, a recovery capacitor C1, switching elements S1, S2, and reverse blocking diodes D1, D2, and a voltage clamp circuit which has switching elements S5, S6 and a constant voltage power supply V1 of a voltage Vsus. The power recovery circuit causes LC-resonance between the capacitive load of PDP 10 and the coil L1 by using the coil L1 as an inductance element, and recovers and supplies electric power. During recovery of electric power, electric power accumulated in capacitive load generated in the scan electrode is transferred to the recovery capacitor C1 via the current reverse blocking diode D2 and switching element S2. During supply of electric power, electric power accumulated in recovery capacitor C1 is transferred to PDP 10 via the switching element S1 and reverse blocking diode D1. In this way, the scan electrode of PDP is driven during the sustain period. Consequently, because in the power recovery circuit, in the sustain period, the scan electrode is driven by LC resonance without supplying electric power from the power supply, theoretically, electric power consumption becomes zero.

In FIG. 25, in order to electrically separate the sustain pulse generation circuit 51 from the reset waveform generation circuit 52, switching elements S9 and S10 are inserted in a main discharge pah X between the sustain pulse generation circuit 51 and the reset waveform generation circuit 52 in series and in such a manner that body diodes of each of them are directed in opposite directions. Hereinafter this kind of connection with diodes directed in opposite directions is called "back-to-back connection." By achieving this kind of configuration, simultaneously turning off switching elements S9 and S10 can shut off both currents including current that flows from the sustain pulse generation circuit 51 to the reset waveform generation circuit 52 and current that flows from the reset waveform generation circuit 52 to the sustain pulse generation circuit 51. Thus, it becomes possible to electrically separate the sustain pulse generation circuit 51 from the reset waveform generation circuit 52.

This is intended to prevent influence of the constant-voltage power supply V1 of the sustain pulse generation circuit 51 with lower potential from being exerted when electric power is supplied from the constant-voltage power supply V2 of the reset waveform generation circuit 52, and to prevent influence of potential higher than that, that is, grounding potential (hereinafter simply written "GND") of a clamp section of the sustain pulse generation circuit 51 when electric power is supplied from constant-voltage power supply V3 of negative potential in the reset waveform generation circuit 52.

In addition, since large current as large as several hundreds of ampere may flow instantaneously when PDP 10 is driven, in a drive circuit of PDP 10, a large number of MOSFETs are installed in parallel to form switching elements to proof such large current. In switching elements S9 and S10 inserted in series between the sustain pulse generation circuit 51 and the reset waveform generation circuit 52 in order to electrically separate the sustain pulse generation circuit 51 from the main discharge path, a large number of MOSFETs are installed to form switching elements in the same manner.

Impedance generated on the main discharge path by the switching elements S9 and S10 consumes ineffective electric power which does not contribute to light emission by the current that flows when the sustain pulse generation circuit 51 drives a scan electrode and generates unrequired joule heat associated with the electric power consumption. In particular, in a power recovery circuit, electric power consumption is cut down by recovering electric power accumulated in capacitive load of PDP 10 and reusing it, and thus in the event electric power is ineffectively consumed by such impedance, the electric power recovery ratio is degraded and electric power consumption reduction effect is lowered.

In order to solve this problem, a technique to install switching elements in a voltage clamp circuit of the sustain pulse generation circuit 51 in place of switching elements S9 and S10 is proposed (see, for example, patent document 2).

FIG. 26 is a circuit diagram of a scan electrode drive circuit 521 with switching elements S101 and S102 installed in a voltage clamp circuit of sustain pulse generation circuit 51 and a sustain electrode drive circuit 6.

In FIG. 26, in place of switching elements S9 and S10 in FIG. 25, switching elements S101 and S102 are installed to a voltage clamp circuit of the sustain pulse generation circuit 5121. And switching element S101 is disposed to achieve back-to-back connection with the switching element S5 and the switching element 102 is disposed to achieve back-to-back connection with the switching element S6.

Under this configuration, turning off switching element S5 and switching element S101 simultaneously can electrically separate the constant-voltage power supply V1 from the main discharge path, and turning off switching element S6 and switching element S102 simultaneously can electrically separate GND of the voltage clamp circuit from the main discharge path.

Patent document 1: JP 07-109542, A

Patent document 2: JP 2005-70787, A

DISCLOSURE OF INVENTION

However, in the configuration shown in FIG. 26, the point is not changed in that a large number of MOSFETs are used to configure switching elements S101 and S102 to proof large current of several hundreds of ampere which instantaneously flows when PDP 10 is driven, and consequently, the problem of increasing the number of elements which compose the PDP drive circuit and increasing the circuit installation area is not solved.

In general, there are diodes which have larger maximum rated values as compared to switching elements such as MOSFETs, and By using such diodes with large rated values, circuits which can proof large current with smaller number of elements can be configured as compared to the case in which MOSFET is used. Therefore, in order to reduce an installation area of PDP drive circuit, it is possible to think of a configuration in which switching elements S101 and S102 are replaced with such diodes (referred to as "replacing diode") with large rated values. By adopting such configuration, as compared to the case of FIG. 26, the installation area of drive circuit can be reduced.

However, under such configuration, for example, when the potential of the main discharge path becomes Vset by the electric power supply from the constant-voltage power supply V2, the potential on the cathode side of the replacing diode becomes Vset which is higher than Vsus while the potential on the anode side of the replacing diode is Vsus by the constant-voltage power supply V1. Thus no current flows from anode side to the cathode side of the replacing diode. If such thing occurs, it is unable to supply electric power from the constant-voltage power supply V1 to the main discharge path and it is unable to generate normal drive waveforms. In order to supply electric power from the constant-voltage power supply V1 to the main discharge path, potential of the main discharge path must be lowered from Vset to Vsus or lower so that current can flow from the anode side to the cathode side of the replacing diode. However, in the event that switch S6 and switch S22 are turned off, the path to transfer electric charge accumulated in the main discharge path is shut off, the potential of the main discharge path is kept at Vset.

As described above, in conventional technologies, by having a configuration with switching elements installed in a voltage clamp circuit of a sustain pulse generation circuit, it is possible to reduce impedance when a scan electrode is driven from a power recovery circuit of a sustain pulse generation circuit and to reduce electric power consumption by increasing the electric power recovery ratio. However switching elements must be configured by use of a large number of MOSFETs, etc. to proof large current of hundreds of ampere which flow instantaneously when PDP 10 is driven. This causes problems in that the number of elements that configures the PDP drive circuit increases and the installation area increases.

In addition, even if the number of elements that configure the PDP drive circuit is reduced by replacing switching elements consisting of MOSFETs, etc. with diodes with large maximum rated value in order to reduce the installation area of the PDP drive circuit, there still remains a problem in that switching control to normally generate drive waveform is extremely difficult or strain to the drive waveform is generated.

The present invention has been made in view of these problems, and it is an object of the present invention to provide a PDP drive circuit and a plasma display apparatus, which has a power recovery circuit, reduces impedance when a scan electrode is driven from the power recovery circuit, and improves the electric power recovery ratio. Particularly the PDP drive circuit and plasma display apparatus can reduce the number of elements which make up a drive circuit to reduce the installation area and which can generate drive waveforms with little strain.

The present invention provides the following drive circuits for driving a plasma display panel (PDP) with a plurality of scan electrodes and sustain electrodes to solve the above problems.

In the first aspect of the present invention, a plasma display panel (PDP) drive circuit includes: a pulse voltage generation circuit that includes main switching elements disposed on the high voltage side and main switching elements disposed on the low voltage side, and is operable to generate a pulse voltage by operating the main switching elements in accordance with an output voltage from a first power supply, and apply the pulse voltage to the scan electrodes and/or sustain electrodes of the plasma display panel; and a reset voltage generation circuit operable to generate a reset voltage in accordance with an output voltage from a second power supply that outputs a voltage higher than the output voltage of the first power supply and apply the reset voltage to the plasma display panel. The pulse voltage generator circuit includes a first diode operable to prevent the voltage outputted by the reset voltage generation circuit from being applied in reverse direction to the first power supply and a first switching element connected to the first diode in parallel.

In the second aspect of the present invention, a PDP drive circuit includes: a pulse voltage generation circuit that includes main switching elements disposed on the high voltage side and main switching elements disposed on the low voltage side, and is operable to generate a pulse voltage by operating the main switching elements in accordance with an output voltage from a first power supply, and apply the pulse voltage to the scan electrodes and/or sustain electrodes of the plasma display panel; a second reset voltage generation circuit operable to generate a second reset voltage in accordance with an output voltage from a third power supply that outputs a voltage lower than the output voltage of the first power supply and apply the second reset voltage to the plasma display panel; a second diode operable to prevent the voltage output by the second reset voltage generation circuit from being applied in reverse direction to the first power supply; and a second switching element connected to the second diode in parallel.

In the third embodiment of the present invention, a PDP drive circuit includes: a pulse voltage generation circuit that includes main switching elements disposed on the high voltage side and main switching elements disposed on the low voltage side, and is operable to generate a pulse voltage by operating the main switching elements in accordance with an output voltage from a first power supply, and apply the pulse voltage to the scan electrodes and/or sustain electrodes of the plasma display panel; a reset voltage generation circuit operable to generate a reset voltage in accordance with an output voltage from a second power supply that outputs a voltage higher than the output voltage of the first power supply and apply the reset voltage to the plasma display panel; a first diode operable to prevent the voltage outputted by the reset voltage generation circuit from being applied in reverse direction to the first power supply; a first power recovery circuit operable to resonate with a capacitive load of the plasma display panel and recover electric power accumulated in the plasma display panel; a second power recovery circuit operable to supply the recovered electric power to the plasma display panel; a third diode (D110) that allows a current to flow into the first power supply while shutting off a current flowing from the first power supply to the scan electrode; and a switching element that is connected to the third diode in series and is operable to control flowing and shutoff of a current to the first power supply.

In the fourth aspect of the present invention, a PDP drive circuit includes: a pulse voltage generation circuit that contains main switching elements disposed on the high voltage side and main switching elements disposed on the low voltage side, and is operable to generate a pulse voltage by operating the main switching elements in accordance with an output voltage from a first power supply, and apply the pulse voltage to the scan electrodes and/or sustain electrodes of the plasma display panel; a second reset voltage generation circuit operable to generate a second reset voltage in accordance with an output voltage from a third power supply that outputs a voltage lower than the output voltage of the first power supply, and apply to the plasma display panel; a second diode operable to prevent the voltage outputted by the second reset voltage generation circuit from being applied in reverse direction to the first power supply; a first power recovery circuit operable to resonate with a capacitive load of the plasma display panel and recover electric power accumulated in the plasma display panel; a second power recovery operable to supply the recovered electric power to the plasma display panel; a fourth diode operable to shut off a current flowing from the first power supply to a ground; and a fourth switching element connected to the fourth diode in series, and operable to control flowing/shutoff of a current from the ground via the fourth diode.

In the fifth aspect of the present invention, a PDP drive circuit includes: a pulse voltage generation circuit that contains a high-side main switching element (S5) disposed on the high-voltage side and a low-side main switching element (S6) disposed on the low-voltage side, generates a pulse voltage by operating the main switching elements in accordance with an output voltage from a first power supply (V1), and applies the pulse voltage to the scan electrodes and/or sustain electrodes on the plasma display panel;

a first reset voltage generation circuit (V2, S21) that generates a first reset voltage in accordance with an output voltage (Vset) from a second power supply (V2) which outputs the voltage higher than the output voltage of the first power supply, and applies the first reset voltage to the plasma display panel;

a second reset voltage generation circuit (V3, S22) operable to generate a second reset voltage in accordance with an output voltage (Vad) from a third power supply (V3) which outputs the voltage lower than the output voltage of the first power supply, and apply the second reset voltage to the plasma display panel;

a diode (D11) that is connected on the lower voltage side of the high-side main switching element (S5) and is operable to prevent a voltage outputted by the reset voltage generation circuit from being applied backward to the first power supply;

a switching element (S11) connected to the diode in parallel;

a switching element (S9) inserted in a main discharge path, and operable to prevent a voltage outputted by the second reset voltage generation circuit from being applied backward to a reference potential of the first power supply;

a first power recovery circuit (C1, S2, D2, L1B) operable to recover electric power accumulated in a capacitive load of the plasma display panel;

a second power recovery circuit (C1, S1, D1, L1A) operable to supply the recovered electric power to the plasma display panel; and a scan IC (IC31) that is a circuit operable to select a scanning electrode for applying a voltage for address discharge, and has input terminals on the high-voltage side and low-voltage side.

The second power recovery circuit is connected to an node connecting the high-side main switching element and the diode. The first power recovery circuit is connected to a terminal of the diode which is not connected to the high-side main switching element. The first reset voltage generation circuit is connected to the high voltage side of the scan IC, and the second reset voltage generation circuit is connected to the low voltage side of the scan IC.

In the sixth aspect of the present invention, a plasma display apparatus is provided. The plasma display apparatus contains a plasma display panel that has a plurality of scan electrodes and sustain electrodes, and the PDP drive circuit described above which drives the plasma display panel.

According to the present invention, it is possible to provide a PDP drive circuit and plasma display apparatus which have a power recovery circuit utilizing a resonance circuit, and have electric power recovery ratio improved by reducing impedance when scan electrodes are driven from the electric recovery circuit. They can reduce the installation area by reducing the number of elements which compose the drive circuit and at the same time can generate drive waveforms with little strain.

DESCRIPTION OF REFERENCE NUMERALS

Figure 1:
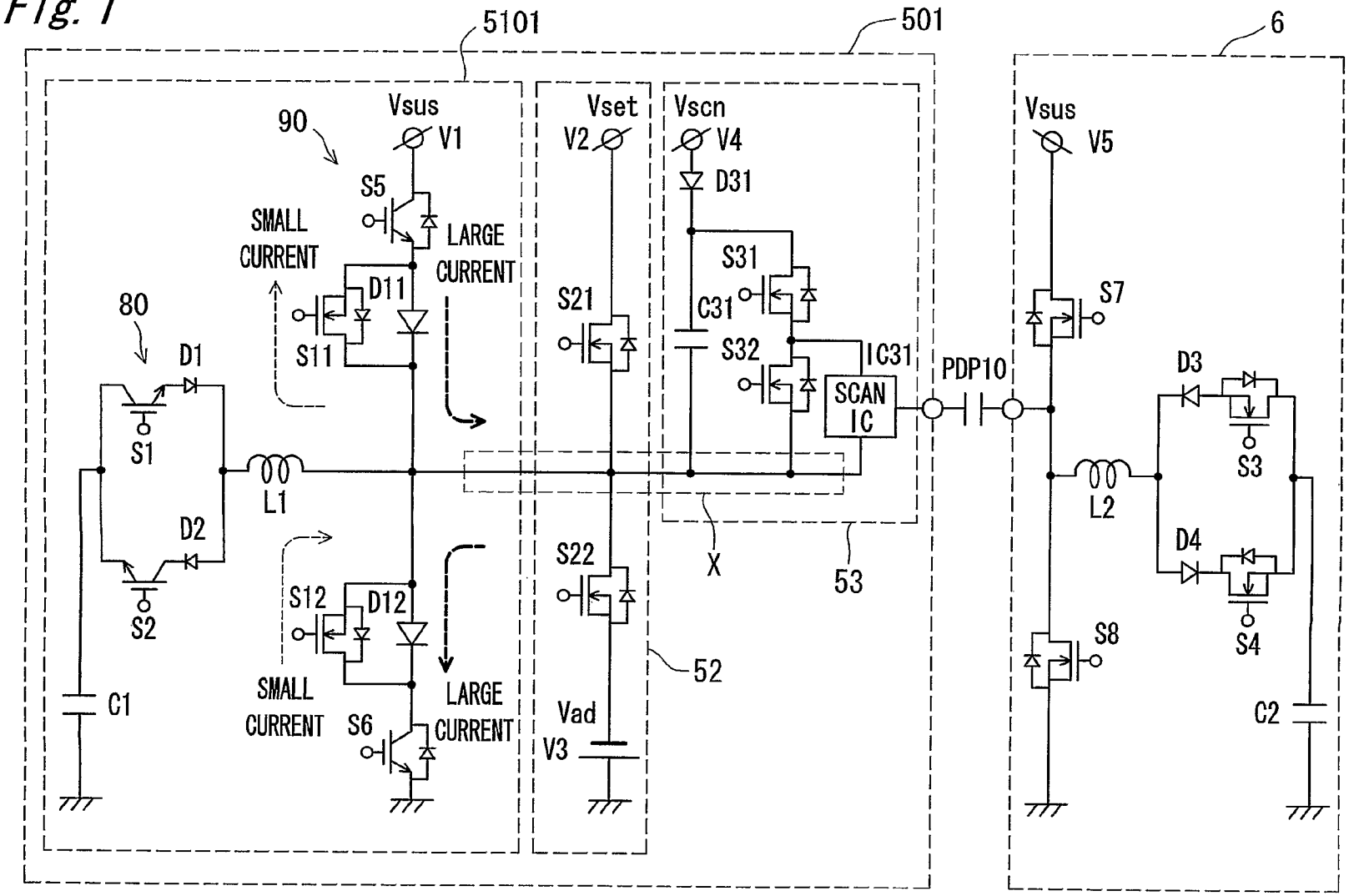
FIG. 1 is an illustration of a PDP drive circuit configuration in embodiment 1 of the present invention.

1 AD converter
2 Video signal processing circuit
3 Subfield processing circuit
4 Data electrode drive circuit
5, 501, 502, 503, 504, 505, 506, 507, 508, 509, 510, 511, 512, 513, 514, 521, 522 Scan electrode drive circuit
6 Sustain electrode drive circuit
10 Plasma display panel (PDP)
22 Scan electrode
23 Sustain electrode
32 Data electrode
51, 61, 5101, 5102, 5103, 5104, 5105, 5106, 5107, 5108, 5109, 5110, 5111, 5112, 5113, 5114, 5121, 5122 Sustain pulse generation circuit
52 Reset waveform generation circuit
53 Scan pulse generation circuit
C1, C2 Recovery capacitor
C31 Capacitor
L1, L2, L1A, L1B Coil
D1, D2, D3, D4, D11, D12, D31, D101, D102, D110, D120 Diode
S1, S2, S3, S4, s5, S6, S7, S8, S9, S10, S11, S12, S21, S22, S31, S32, S101, S102, S110, S120 Switching elements
V1, V2, V3, V4, V5 Constant-voltage power supply
IC31 Scan IC

BEST MODE FOR CARRYING OUT THE INVENTION

Referring now to the drawings, preferred embodiments of the invention are described specifically below.

Embodiment 1

1-1 Configuration

FIG. 1 is an illustration that shows a configuration of a PDP drive circuit in embodiment 1 of the present invention. The PDP drive circuit shown in FIG. 1 is a circuit which applies drive voltage to electrodes of a plasma display panel (PDP) to drive the PDP. Before explaining the configuration and operation of the PDP drive circuit in detail, description is made on the PDP configuration and operation.

1-1-1 PDP Structure

Figure 2:
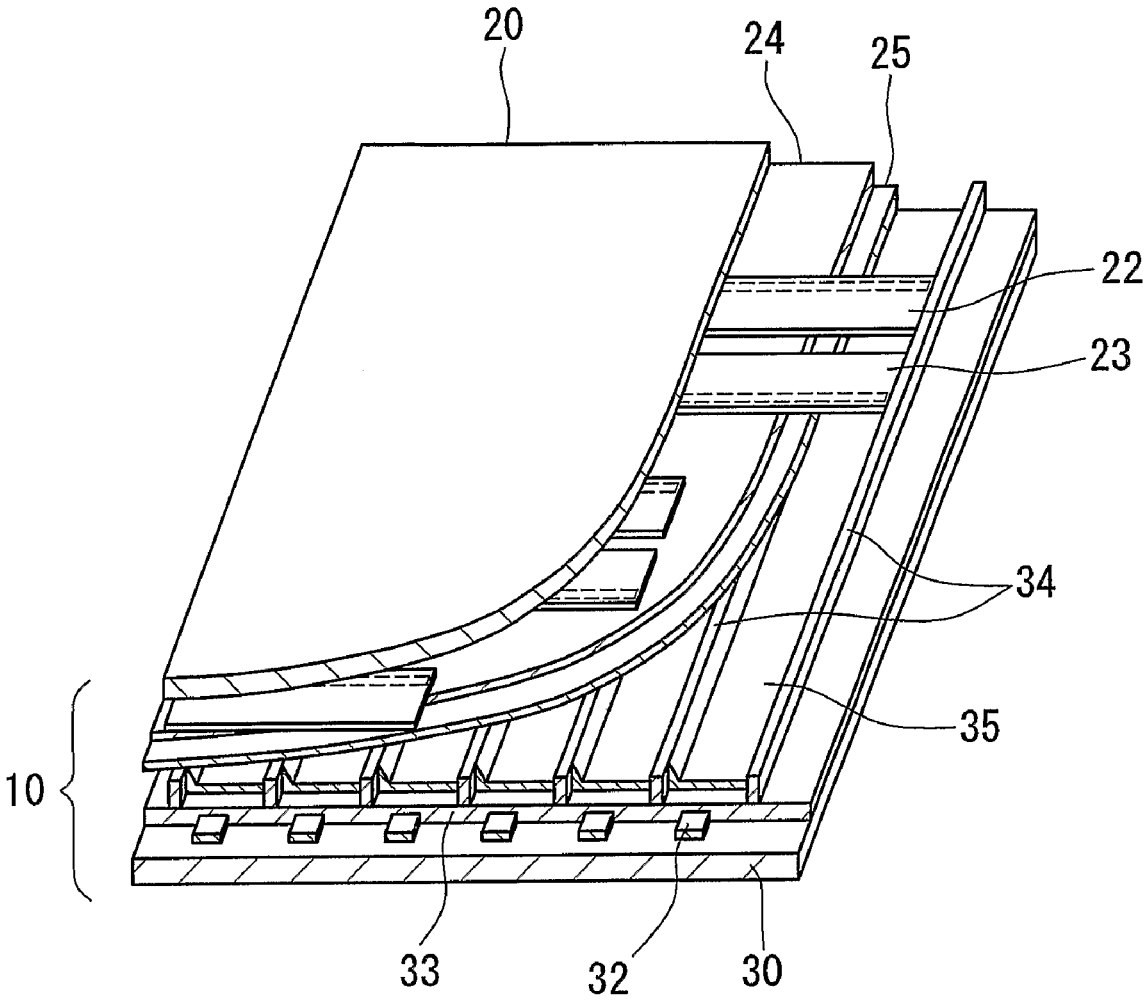
FIG. 2 is a perspective view of the PDP structure.

FIG. 2 is a perspective view that indicates PDP structure. On a front plane 20 made of glass, which is the first substrate, a plurality of display electrodes forming a pair with stripe-form scan electrode 22 and sustain electrode 23 are formed. A dielectric layer 24 is formed to cover the scan electrode 22 and sustain electrode 23, and a protective layer 25 is formed on the dielectric layer 24.

On a back plane 30 which is the second substrate, a plurality of stripe-form data electrodes 32 covered with dielectric layer 33 are formed in such a manner that a plurality of data electrodes 32 make overhead crossing with scan electrodes 22 and sustain electrodes 23. On the dielectric layer 33, a plurality of bulkheads 34 are disposed in parallel with data electrodes 32, and a phosphor layer 35 is formed on the dielectric layer 33 between these bulkheads 34. In addition, the data electrode 32 is located at the position between adjacent bulkheads 34.

These front plate 20 and back plate-30 are disposed facing each other with a microscopic discharge space between in such a manner that a plurality of data electrodes 32 make overhead crossing with scan electrodes 22 and sustain electrodes 23 and the perimeter portion is sealed with sealing material such as glass frit, etc. In the discharge space, mixture gas of, for example, neon (Ne) and xenon (Xe) is sealed as discharge gas. The discharge space is partitioned into a plurality of compartments by bulkheads 34. To each compartment, phosphor layers 35 that emit light of each color of red (R), green (G) and blue (B) are successively disposed. At portions where the scan electrode 22, sustain electrode 23 and data electrode 32 intersect, discharge cells are formed and by adjacent three discharge cells with phosphor layers 35 formed, which emit light in each color, one pixel is composed. The region in which a discharge cell that composes this pixel is formed becomes an image display region and the perimeter of the image display region becomes a non-display region where no image is displayed, such as regions, etc. where glass frit is formed.

1-1-1-1 PDP Electrode Arrangement

Figure 3:
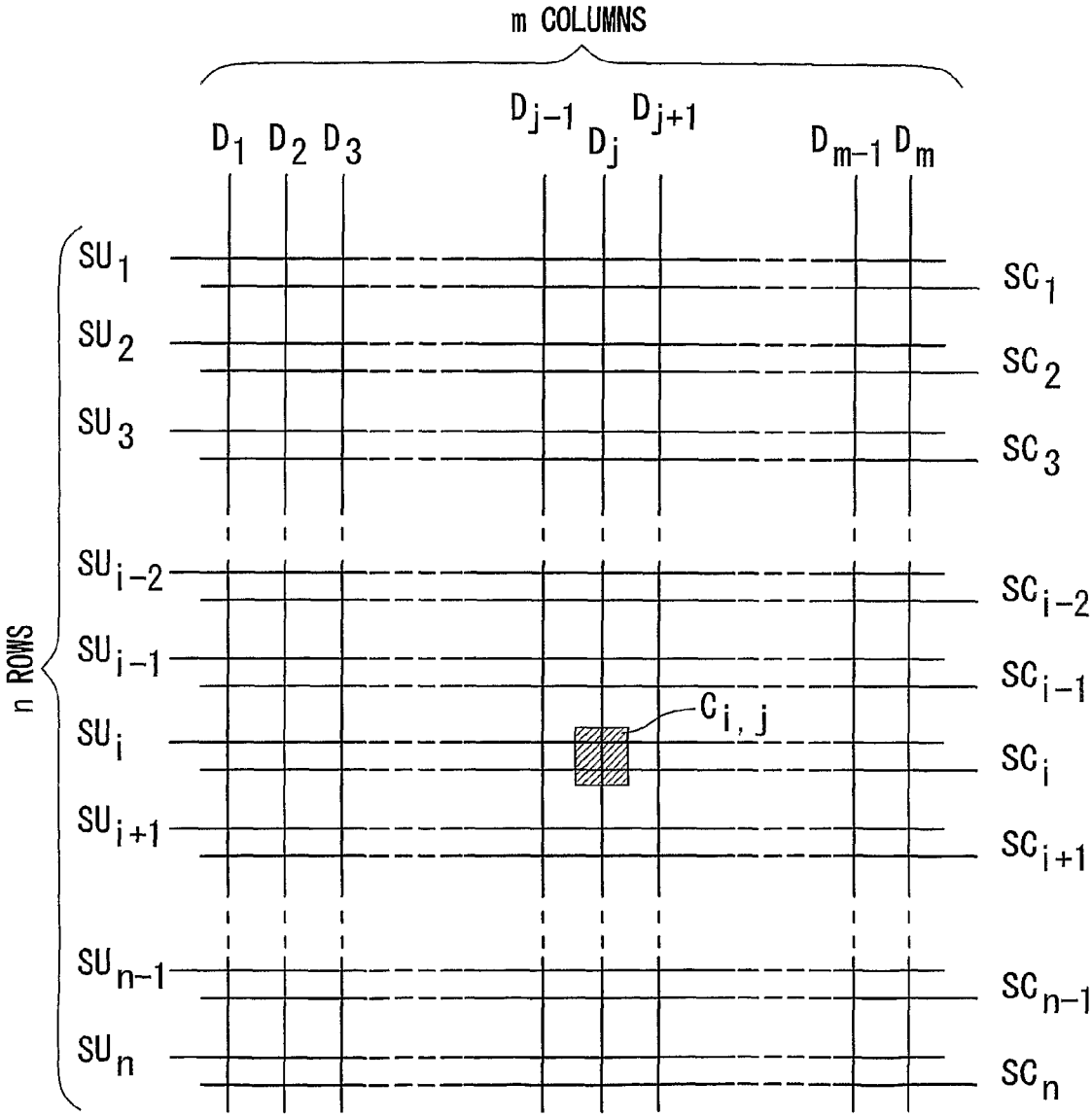
FIG. 3 is an illustration of PDP electrode arrangement.

FIG. 3 is an electrode arrangement diagram of PDP 10. In a row direction, n rows of scan electrodes SC1 through SCn (scan electrode 22 of FIG. 2) and n rows of sustain electrodes SU1 through SUn (sustain electrode 23 of FIG. 2) are alternately arranged, and in the column direction, m columns of data electrodes D1 through Dm (data electrode 32 of FIG. 2) are arranged. A discharge cell Ci,j containing one pair of scan electrode SCi and sustain electrode SUi (i=1 through n) and one data electrode Dj (j=1 through m) are formed in the discharge space, and the total of discharge cells C amounts to (m×n) pieces.

In the PDP 10 with this configuration, ultraviolet ray is generated by gas discharge, to excite phosphors of each color of R, G, and B to emit light, thereby carrying out color display. In addition, in the PDP 10 one field period is divided into a plurality of subfields, and the PDP 10 is driven by combinations of subfields to carry out grey-scale display. Each subfield consists of a reset period, an address period, and a sustain period. In order to display image data, a signal waveform that varies in accord with a reset period, an address period, and a sustain period, respectively, is applied to each electrode.

1-1-1-2 Drive Voltage Waveform of PDP

Figure 4:
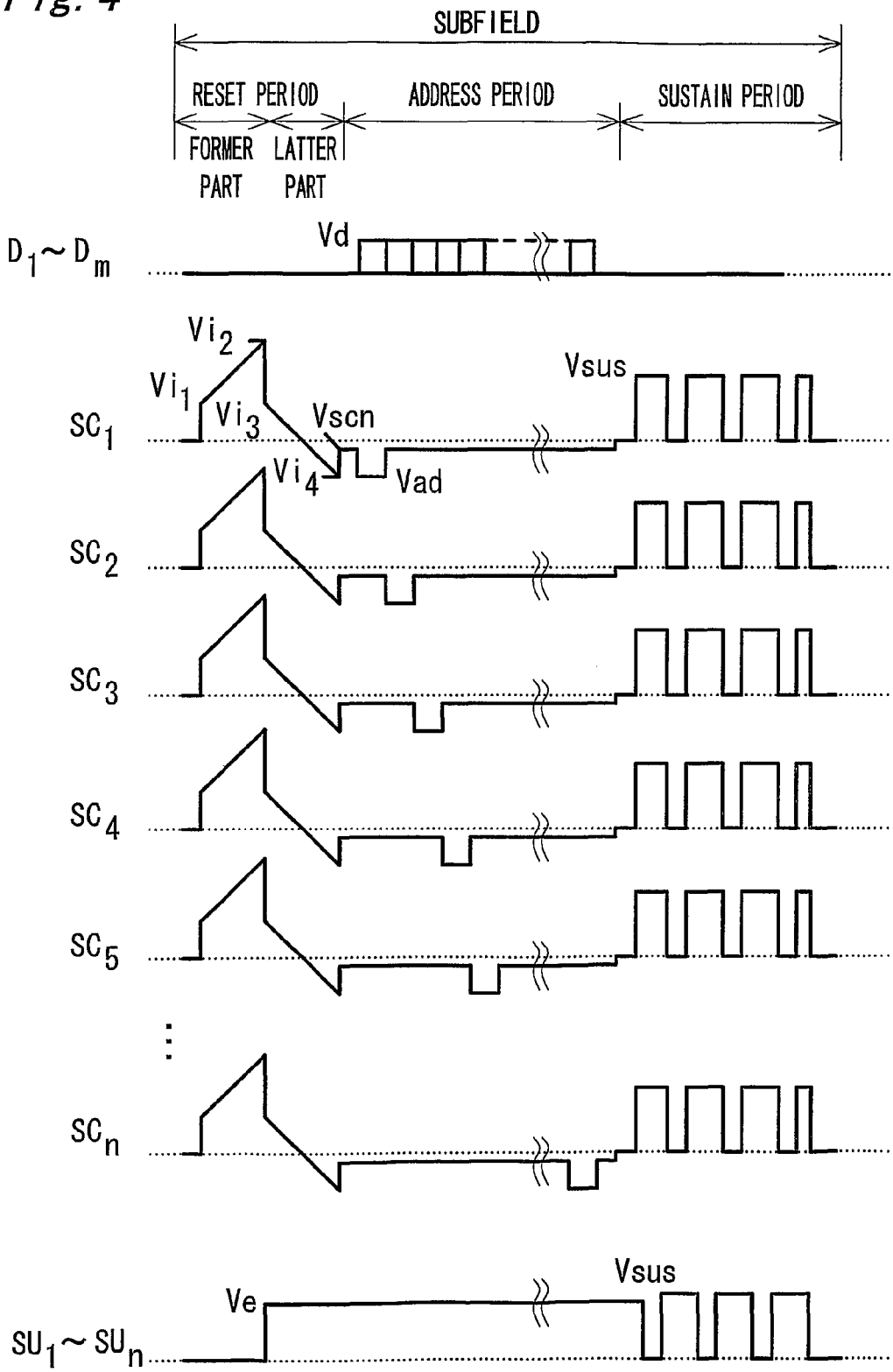
FIG. 4 is an illustration of drive voltage waveforms applied to electrodes of the PDP.

FIG. 4 is an illustration that indicates each drive voltage waveform applied to each electrode of the PDP 10. As shown in FIG. 4, each subfield has a reset period, an address period, and a sustain period. In addition, since relevant subfields carry out nearly same operations except varying number of sustain pulses during the sustain period in order to vary weights of the light-emitting period, and operating principle in each subfield is nearly same, in this part of the section, operation is explained for one subfield only.

First of all, during the reset period, for example, the positive pulse voltage is applied to all the scan electrodes SC1 through SCn to accumulate necessary wall charges on protective layer 25 and phosphor layer 35 on dielectric layer 24 that covers scan electrodes SC1 through SCn and sustain electrodes SU1 through SUn. In addition, it generates priming (detonator for discharge=exciting particles) which reduces delay in discharge and stably generates address discharge.

Specifically, in the first half of the reset period, data electrodes D1 through Dm and sustain electrodes SU1 through SUn are held to 0 (V), respectively, and for scan electrodes SC1 through SCn, a slope waveform voltage which slowly rises from voltage Vi1 lower than the discharge start voltage to a voltage Vi2 higher than a discharge start voltage is applied to data electrodes D1 through Dm. While this slope waveform voltage is rising, the first faint reset discharge occurs between scan electrodes SC1 through SCn and sustain electrodes SU1 through SUn, and data electrodes D1 through Dm, respectively. Negative wall voltage is accumulated on the top of scan electrodes SC1 through SCn, and at the same time, positive wall voltage is accumulated on tops of data electrodes D1 through Dm and sustain electrodes SU1 through SUn. Wall voltage of the top of an electrode means voltage generated by wall charges accumulated on the dielectric layer that covers the electrode.

In the second half of the reset period, sustain electrodes SU1 through SUn are kept at positive voltage Ve, and scan electrodes SC1 through SCn are applied with slope waveform voltage which slowly lowers from voltage Vi3 lower than the discharge start voltage for sustain electrodes SU1 through SUn to voltage Vi4 that exceeds the discharge start voltage is applied. During this period, the second faint reset discharge occurs between scan electrodes SC1 through SCn and sustain electrodes SU1 through SUn, and data electrodes D1 through Dm, respectively. Negative wall voltage on top of scan electrodes SC1 through SCn and positive wall voltage on top of sustain electrodes SU1 through SUn are attenuated, and the positive wall voltage on the top of data electrodes D1 through Dm is adjusted to a value suited for writing operation. This concludes the reset operation (hereinafter the drive voltage waveform applied to each electrode during the reset period is called the "reset waveform.").

Then, in the address period, scan is carried out by applying a negative scan pulse successively to all the scan electrodes SC1 through SCn. While scan electrodes SC1 through SCn are scanned, based on the display data, positive write pulse voltage is applied to data electrodes D1 through Dm. In this way, the address discharge is generated between scan electrodes SC1 through SCn and data electrodes D1 through Dm, and a wall charge is formed on the surface of the protective layer 25 on scan electrodes SC1 through SCn.

Specifically, in the address period, scan electrodes SC1 through SCn are temporarily kept at voltage Vscn. Then, in address operation of discharge cells Cp,1 through Cp,m (p is integer of 1 through n), the scan pulse voltage Vad is applied to the scan electrode SCp, and at the same time, the positive write pulse voltage Vd is applied to the data electrode Dq (Dq is the data electrode to be selected from D1 through Dm on the basis of video signals) which corresponds to video signals to be displayed on p-th row of data electrodes. In this way, address discharge is generated at the discharge cell Cp,q which corresponds to the intersecting portion between the data electrode Dq with the write pulse voltage applied and the scan electrode SCP with the scan pulse voltage applied. By this address discharge, positive voltage is accumulated on the top of the scan electrode SCp of the discharge cell Cp,q, negative voltage is accumulated on the top of the sustain electrode SUp, and the address operation is finished. Thereafter, the same address operation is carried out up to the discharge cells Cn,q on the n-th rows and thus address operation is finished.

In the following sustain period, a voltage sufficient to maintain discharge is applied between scan electrodes SC1 through SCn and sustain electrodes SU1 through SUn for a specified period. By this, discharge plasma is generated between scan electrodes SC1 through SCn and sustain electrodes SU1 through SUn, to excite the phosphor layer to emit light for a specified period. In such event, in the discharge space to which no write pulse voltage is applied during the address period, no discharge is generated and the phosphor layer 35 is not excited to emit light.

Specifically, in the sustain period, after scan electrodes SC1 through SCn are temporarily returned to 0 (V), sustain electrodes SU1 through SUn are returned to 0 (V). Thereafter, positive sustain pulse voltage Vsus is applied to scan electrodes SC1 through SCn. In such event, the voltage between the top of the scan electrode SCp and the top of sustain electrode SUp at the discharge cell Cp,q which gives rise to address discharge is added with the wall voltage accumulated on the top of the scan electrode SCp and on the top of the sustain electrode SUp, in addition to the positive sustain pulse voltage Vsus during the address period, and becomes bigger than the discharge start voltage. Thus the first sustain discharge occurs. At the discharge cell Cp,q which caused sustain discharge, negative voltage is accumulated on the top of the scan electrode SCp and positive voltage is accumulated on the top of the sustain electrode SUp, so that the potential difference between the scan electrode SCP and the sustain electrode SUp at the time of occurrence of sustain discharge is cancelled. In this way, the first sustain discharge ends. After the first sustain discharge, scan electrodes SC1 through SCn are returned to 0 (V), and thereafter Vsus is applied to sustain electrodes SU1 through SUn. In such event, the voltage between the top of the scan electrode SCp and the top of the sustain electrode SUp at the discharge cell Cp,q which brought on the first sustain discharge is added with the wall voltage accumulated on the top of the scan electrode SCp and on the top of the sustain electrode SUp during the first sustain discharge added in addition to the positive sustain pulse voltage Vsus and becomes bigger than the discharge start voltage. Thus, the second sustain discharge occurs. Thereafter, in the same manner, by alternately applying sustain pulses to scan electrodes SC1 through SCn and sustain electrodes SU1 through SUn, sustain discharge is continuously carried out, by the number of times of sustain pulses, to the discharge cell Cp,q which has brought on the address discharge.

1-1-2 Configuration of PDP Drive Circuit

Going back to FIG. 1, operation of the PDP drive circuit will be described. The PDP drive circuit in the present embodiment is equipped with a scan electrode drive circuit 501 and sustain electrode drive circuit 6. The scan electrode drive circuit 501 and the sustain electrode drive circuit 6 include power recovery circuits, respectively. The scan electrode drive circuit 501 has a sustain pulse generation circuit 5101 and the reset waveform generation circuit 52, and the scan pulse generation circuit 53.

The sustain pulse generation circuit 5101 includes a power recovery circuit 80 and a voltage clamp circuit 90. The power recovery circuit 80 is equipped with a coil L1, a recovery capacitor C1, switching elements S1 and S2, and reverse blocking diodes D1 and D2.

In addition, the voltage clamp circuit 90 has a constant-voltage power supply V1 which supplies sustain voltage Vsus, the first power supply, a switching element S5 which is a power supply clamp switch, and a switching element S6 which is a ground clamp switch. The voltage clamp circuit 90 is further equipped with a diode D11 which is a first diode connected to the switching element S5 in series and shutting off the current flowing into the constant-voltage power supply V1, a switching element S11 which is a first switch, connected to the diode D11 in parallel and capable of changing over whether to shut off or to pass the current flowing into the constant-voltage power supply V1, a diode D12 which is a second diode connected to the switching element S6 in series and shutting off the current flowing from GND of the voltage clamp circuit 90 into the main discharge path X via the switching element S6, and a switching element S12 which is a second switch connected to the diode D12 in parallel and capable of changing over whether to shut off or to pass the current flowing from GND of the voltage clamp circuit 90 into the main discharge path X via the switching element S6. The switching element S11 is disposed in such a direction that its body diode shuts off the current flowing from the main discharge path X to the constant-voltage power supply V1. The switching element 12 is disposed in such a direction that its body diode shuts off the current flowing from GND of the voltage clamp circuit 90 to the main discharge path X.

Hereinafter, a diode which shuts off a current flowing into the constant-voltage power supply V1 as the diode D11 and a switch S11 connected to the diode D11 in parallel are called a "Vset separation switch." In addition, a switch as the diode D12 that shuts off a current flowing from GND to the main discharge path via the switching element S6 is called a "Vad separation switch."

In the sustain pulse generation circuit 5101, by changing over switching elements S1, S2, S5, and S6, the power recovery circuit 80 and the voltage clamp circuit 90 are changed over to generate the sustain pulse to be applied to scan electrodes SC1 through SCn. In the power recovery circuit 80, by using a coil L1 which is an inductance element, a capacitive load (capacitive load generated in scan electrodes SC1 through SCn of FIG. 3) of the PDP 10 and an inductance of the coil L1 are LC-resonated to recover and supply the electric power. In the voltage clamp circuit 90, electric power is supplied from the constant-voltage power supply V1 of the voltage Vsus to scan electrodes SC1 through SCn via the switching element S5 and diode D11 to clamp scan electrodes SC1 through SCn to the voltage Vsus. In addition, by clamping scan electrodes SC1 through SCn to the ground potential via diode D12 and switching element S6, scan electrodes SC1 through SCn are driven.

When the PDP 10 is driven, a large current of several hundreds ampere may flow instantaneously. In addition, there are diodes which have larger maximum rated value as compared to switching elements such as MOSFETs. By the use of diodes with a large rated value, a circuit that can proof large current can be configured with a number of elements less than that in the case of forming a switching element by the use of MOSFET, etc.

Therefore, in this embodiment, the diode D11 with a large rated value is used to shut off the current flowing into the constant-voltage power supply V1 and the diode 12 which has large rated value is used to shut off the current flowing from GND of the voltage clamp circuit 90 to the main discharge path X. Thus, it becomes possible to form a drive circuit with a smaller number of elements as compared to the case where a drive circuit is formed by the use of switching elements such as MOSFETs. It is also possible to configure switching elements S11 and S12 with a smaller number of elements. The reason will be discussed later. Consequently in the present embodiment, it becomes possible to configure the PDP drive circuit with the number of elements reduced from conventional cases. The detail of operations of these switching elements S11 and S12 will be discussed later.

In addition, switching elements S11 and S12 are configured by generally known elements, such as MOSFETs, which carry out switching operations. For the portion in which switching operation is carried out, a body diode is formed in anti-parallel. Thus, it is possible to allow the current which is to flow in the forward direction to the body diode even when the switching operation is in the shut-off state. In addition, switching elements S1, S2, S5, and S6 are composed of generally known insulated gate bipolar transistors (IGBT) which have characteristics of low loss and simple control even during high-voltage operation. This is adopted in view of a large current of several hundreds of ampere that flows when PDP 10 is driven. In addition, with respect to switching elements S5 and S6, since no parasitic diode is generated in IGBT, diodes which are equivalent to the body diode parasitically generated in MOSFET are installed in anti-parallel with switching elements S5 and S6. In such event, a diode which is installed in anti-parallel with the switching element S5 is disposed in the direction to shut off the current flowing from the constant-voltage power supply V1 to the main discharge patch X and a diode which is installed in anti-parallel with the switching element S6 is disposed in the direction to shut off the current flowing from the main discharge patch X to GND.

In the present embodiment, there is no intention to limit these switching elements to any specific kind but switching elements S11 and S12 may be configured with IGBT or switching elements S1, S2, S5, and s6 may be configured with MOSFET, or a configuration to use other generally known elements which carry out switching operation may be adopted.

The reset waveform generation circuit 52 has switching elements S21 and S22 composed of generally known elements such as MOSFETs which carry out switching operation, a constant-voltage power supply V2 of voltage Vset, which is the second power supply with higher potential than the constant-voltage power supply V1, and a constant-voltage power supply V3 of negative voltage Vad, the third power supply. The electric power is supplied from the constant-voltage power supply V2 to scan electrodes SC1 through SC2 via a switching element S21, and the electric power which is a negative potential is supplied from the constant-voltage power supply V3 to scan electrodes SC1 through SCn via a switching element S22, and reset waveform is generated. In addition, the switching element S21 is disposed in such a direction that its body diode shuts off the current which flows from the constant-voltage power supply V2 to the main discharge path. The switching element 22 is disposed in such a manner that its body diode shuts off the current flowing from the main discharge path X to the constant-voltage power supply V3.

In the first half of the reset period, the reset waveform generation circuit 52 generates slope waveform which slowly rises from the voltage Vi1 lower than the discharge start voltage towards voltage Vi2, that is, Vset which exceeds the discharge start voltage, for data electrodes D1 through Dm. In the second half of the reset period, it generates slope waveform which slowly lowers from the voltage Vi3 lower than the discharge start voltage towards voltage Vi4, that is, Vad which exceeds the discharge start voltage, for sustain electrodes SU1 through SUn. Hence the waveform is applied to scan electrodes SC1 through SCn.

The scan pulse generation circuit 53 has switching elements S31, S32 composed of generally known elements which carry out switching operation such as MOSFETs, a constant-voltage power supply V4 of voltage Vscn, a reverse blocking diode D31 that prevents the current from flowing into the constant-voltage power supply V4, a capacitor C31, and a scan IC (IC31) which carries out switching operation. The scan pulse generation circuit 53 generates negative scan pulses during the address period and successively applies to scan electrodes SC1 through SCn. The scan IC (IC31) is a circuit to select scan electrodes SC1 through SCn to which the voltage for address discharge shall be applied.

These switching elements S1, S2, S5, S6, S21, S22, S31, and S32 as well as scan IC (IC31) are controlled for changeover in accordance with subfield control signals generated in the subfield processing circuit 3.

1-2 Operation of PDP Drive Circuit

The PDP drive circuit operation will be discussed with particular emphasis on the operation of switching elements S11 and S12. The drive voltage waveforms applied during the reset period, address period, and sustain period are as per shown in FIG. 4.

1-2-1 Reset Period

First of all, description will be made on the operation of switching elements S11 and S12 during the reset period, that is, the period when scan electrodes SC1 through SCn are driven by the reset waveform generation circuit 52.

In the voltage clamp circuit 90 of the sustain pulse generation circuit 5101, a diode D11 is disposed in the direction to shut off the current flowing into the constant-voltage power supply V1, and the switching element S11 is disposed in the direction in such a manner as for its body diode to shut off the current flowing into the constant-voltage power supply V1.

By having this kind of configuration, turning off the switching element S11 can shut off both the current that flows from the constant-voltage power supply V1 to the main discharge path X and the current that flows from the main discharge path X to the constant-voltage power supply V1 because switching element S5 is off. Thus it can electrically separate the constant-voltage power supply V1 from the reset waveform generation circuit 52. When only current flowing from the main discharge path X to the constant voltage supply V1 is shut off, the switching element S5 can be on, which causes no problem. By such a configuration, when scan electrodes SC1 through SCn are driven by the constant-voltage power supply V2 with higher potential than the constant-voltage power supply V1, the current flowing from the constant-voltage power supply V2 to the constant-voltage power supply V1 can be shut off and voltage drop of the main discharge path X and strain of drive waveform generated as a result of it can be prevented.

In addition, in the voltage clamp circuit of the sustain pulse generation circuit 5101, the diode D12 is disposed in the direction to shut off the current flowing from GND of the voltage clamp circuit into the main discharge path X, and the switching element S12 is disposed in the direction in such a manner as for its body diode to shut off the current flowing from GND of the voltage clamp circuit 90 into the main discharge path X.

By having this configuration, turning off the switching element S12 can shut off both the current that flows from the main discharge path X to GND of the voltage clamp circuit 90 and the current that flows from GND of the voltage clamp circuit 90 to the main discharge path because switching element S6 is turned off, and can electrically separate GND of the voltage clamp circuit 90 from the reset waveform generation circuit 52. When only current flowing from GND of the voltage clamp circuit 90 to the constant main discharge path is shut OFF, the switching element S6 can be ON, which causes no problem. By this, when scan electrodes SC1 through SCn are driven by the constant-voltage power supply V3 with negative potential, the current flowing from GND of the voltage clamp circuit 90 to the constant-voltage power supply V3 can be shut off and voltage increase of the main discharge path and strain of drive waveform generated as a result of it can be prevented.

Consequently, in the first half portion of the reset period, the switching element S11 is off, the constant-voltage power supply V1 and GND of the voltage clamp circuit 90 can be electrically separated from the main discharge path and the reset waveform generation circuit 52 is allowed to stably generate slope waveforms which slowly increase voltage Vi1 to voltage Vi2, that is, voltage Vset.

On the other hand, when the potential of the main discharge path X reaches the voltage Vset by electric power supply from the constant-voltage power supply V2, the cathode-side potential of the diode D11 becomes the voltage Vset which is higher than the voltage Vsus, whereas the anode-side potential of the diode D11 is the voltage Vsus by the constant-voltage power supply V1, resulting in the electrically blocked-out condition where the current is prevented from flowing from the anode to the cathode of the diode D11. As described above, in the reset waveform in the present embodiment, voltage must be quickly lowered from voltage Vi2 to voltage Vi3 as soon as the first half portion of the reset period is finished. For example, when the voltage Vi3 is equal to the voltage Vsus, it is possible to quickly bring the main discharge path at the potential same as the constant-voltage power supply V1 by electrically connecting the constant-voltage power supply V1 to electrically conduct to the main discharge path to lower the reset waveform from voltage Vi2 to voltage Vi3. However, once the diode D11 is brought into the electrically disconnected condition, it is no longer possible to quickly bring the main discharge path to the potential same as that of constant-voltage power supply V1, and it becomes difficult to generate normal drive waveform.

Therefore, in the present embodiment, as soon as the first half of the reset period is finished, the switching element S11 is turned on. Hence, the constant-voltage power supply V1 is allowed to electrically connected to the main discharge path, and electric charges accumulated in the main discharge path are able to be transferred to the constant-voltage power supply V1 via the switching element S11 and the diode connected to the switching element S5 in antiparallel, and thus the potential of the main discharge path can be quickly brought to the potential same as that of the constant-voltage power supply V1. By the way, in such event, the current that flows in the switching element S11 is primarily attributed to charges accumulated in the main discharge path and forms a comparatively small current. Consequently, the switching element S11 may be of the size that enables this current to flow and is able to be configured with reduced number of elements such as MOSFETs with comparatively small rated value. In addition, because in such event, this current flows to the diode connected to the switching element S5 in antiparallel, the switching element S5 may be either on or off.

In this way, in the second half of the reset period, first of all, the switching element S11 is turned on and the potential of reset waveform is quickly lowered to the voltage Vi3. Thereafter, the switching element S11 or S5 is turned off, and further the switching element S12 is turned off, thus the constant-voltage power supply V1 is electrically separated from the main discharge path, thereby allowing the reset waveform generation circuit 52 to stably generate slope waveforms which gradually lowers from the voltage Vi3 to the voltage Vi4, that is, to the negative voltage Vad.

1-2-2 Address Period

Next description will be made on the operation of switching elements S11 and S12 during the address period, that is, the period for which scan electrodes SC1 through SCn are driven by the scan pulse generation circuit 53.

As described above, in the drive waveforms of scan electrodes SC1 through SCn in the present embodiment, the voltage must be raised from the voltage Vi4 to the voltage Vscn as soon as the second half of the reset period is finished (see FIG. 4). Therefore, the switching element S31 of the scan pulse generation circuit 53 is turned on, the electric power of the voltage value Vscn supplied from the constant-voltage power supply V4 via the reverse blocking diode D31 and switching element S31 is fed to one of the input ports of IC31 which carries out switching operation, and IC31 carries out switching operation to supply the electric power to scan electrodes SC1 through SCn. By a series of these operations, the drive waveform applied to scan electrodes SC1 through SCn quickly rises from voltage Vi4 to the voltage Vscn as soon as the second half of the reset period is finished.

In addition, as shown in FIG. 4, in the address period, scanning is carried out by successively applying negative scan pulses to all the scan electrodes SC1 through SCn. Consequently, in the address period, the switching element S22 of the reset waveform generation circuit 52 is kept turned on and the constant-voltage power supply V3 and the main discharge path X are kept electrically connected to each other. In addition, the switching element S32 of the scan pulse generation circuit 53 is turned off and the switching element S5 of the sustain pulse generation circuit 5101 is turned off. Thus the constant-voltage power supply V1 and GND of the voltage clamp circuit 90 are electrically separated from the main discharge path. Further, the constant-voltage power supply V2 is electrically separated from the main discharge path X by turning off the switching element S21 of the reset waveform generation circuit 52. Thus, the potential of the main discharge path X is kept at negative voltage Vad. In this way, to the other input port of IC31, electric power of the negative voltage Vad is entered from the constant-voltage power supply V3 supplied via the switching element S22. IC31 carries out switching operations in such a manner as to supply the electric power from the constant-voltage power supply V3 to scan electrodes SC1 through SCn in a timing of applying negative scan pulse, and in other occasions, in such a manner as to supply the electric power from the constant-voltage power supply V4 to scan electrodes SC1 through SCn.

1-2-3 Sustain Period

Next description will be made on the operations of switching elements S11 and S12 during the sustain period, that is, the period in which scan electrodes SC1 through SCn are driven by the sustain pulse generation circuit 5101.

As shown in FIG. 4, in drive waveforms of scan electrodes SC1 through SCn in the present embodiment, the drive voltage is brought temporarily to 0 (V) when the address period is finished.

However, when the potential of the main discharge path X becomes the negative voltage Vad by electric power supply from the constant-voltage power supply V3, the potential on the cathode side of diode D12 is made 0 (V) by GND of the voltage clamp circuit 90, whereas the anode-side potential becomes the negative voltage Vad lower than that 0 (V) and the electrically disconnected condition results in which no current is allowed to flow from anode side to cathode side of the diode D12. In order to make the main discharge path be 0 (V), GND of the voltage clamp circuit should be brought to be electrically connected to the main discharge path X. However when the diode D12 comes into the electrically blocked out condition, the main discharge path X is unable to be quickly brought to 0 (V) and it becomes difficult to generate normal drive waveforms.

Therefore, in the present embodiment, as soon as the address period is finished, the switching element S12 is turned on. By doing so, GND of the voltage clamp circuit is connected to the main discharge path, electric charges from GND of the voltage clamp circuit are supplied to the main discharge path X via the diode connected to the switching element S6 in antiparallel and the switching element S12 as to cancel negative electric charges accumulated in the main discharge path X, and the potential of the main discharge path X quickly becomes 0 (V). The current that flows the switching element S12 in such event becomes a comparatively small current that is enough to cancel negative electric charges accumulated in the main discharge path X. Consequently, the switching element S12 may be of a size that can allow this current to flow, and can be configured with reduced number of elements, such as MOSFETs, with comparatively small rated value. In addition, in such event, the current flows in a diode connected to the switching element S6 in antiparallel, and thus it does not need to turn on the switching element S6.

After the potential of the main discharge path becomes 0 (V), by controlling switching elements S1, S2, S5, and S6 in the way of the prior art, when the electric power is recovered, the electric power accumulated in the capacitive load generated in scan electrodes SC1 through SCn is transferred to a recovery capacitor C1 via the reverse blocking diode D2 and switching element S2. When the electric power is supplied, the electric power accumulated in the recovery capacitor C1 can be transferred to scan electrodes SC1 through SCn via the switching element S1 and reverse blocking diode D1. In addition, at the time of clamping, the constant-voltage power supply V1 of the voltage Vsus allows voltages of scan electrodes SC1 through SCn to be kept at V1 via the switching element S5 and diode D11, and also kept at GND via the diode D12 and switching element S6.

In such event, when the rise of sustain pulse by the sustain pulse generation circuit 5101 is configured to take place after the fall of the sustain pulse by the sustain electrode drive circuit 6, the switching element S12 is kept on during the sustain pulse down period. Thus, electric charge of grounding potential is supplied from GND to PDP 10 via the switching element S12. Accordingly it is possible to allow sustain pulses by the sustain electrode drive circuit 6 to have down-waveforms free of strain.

When it is configured to simultaneously carry out fall of sustain pulses by the sustain electrode drive circuit 6 and rise of sustain pulses by the sustain pulse generation circuit 5101, the switching element S12 does not always have to be turned on during the period of fall of sustain pulses by the sustain electrode drive circuit 6. This is because electric charges are supplied from the recovery capacitor C1 to PDP 10 via the switching element S1, and thereby the sustain pulses by the sustain electrode drive circuit 6 become down-waveforms free of strain.

1-3 Effects

As described above, according to the present embodiment, a configuration with diodes D11 and D12 provided to the voltage clamp circuit of the sustain pulse generation circuit 5101 can electrically separate the constant-voltage power supply V1 and GND of the voltage clamp circuit from the main discharge path without disposing a switching element between the sustain pulse generation circuit 5101 and the reset waveform generation circuit 52. Consequently, it is possible to reduce impedance in the main discharge path X from the coil L1 of the power recovery circuit 80 to scan electrodes SC1 through SCn, to improve the recovery ratio of electric power accumulated in the capacitive load of PDP 10, and to achieve reduction of power consumption.

Furthermore, since a drive circuit can be configured by the use of diodes with large rated values, as compared to the case in which MOSFETs and other switching elements are used, the number of elements that compose the drive circuit can be reduced.

Furthermore, since a configuration with the switching element S11 which is connected to the diode D11 in parallel and can switch from shutting off or passing or vice versa the current that flows from the main discharge path X to the constant-voltage power supply V1 is adopted. Thus even if the diode D11 comes into an electrically disconnected state, by turning on the switching element S11, it is possible to allow the current to pass from the main discharge path X to the constant-voltage power supply V1 via the switching element S11 and the diode connected to the switching element S5 in antiparallel. For example, it is possible to quickly transfer electric charges of the voltage Vset accumulated in the main discharge path X to the constant-voltage power supply V1 and to bring the potential of the main discharge path X to the potential equal to that of the constant-voltage power supply V1.

Furthermore, since a configuration with the switching element S12 which is connected to the diode D12 in parallel and can switch from shutting off or passing or vice versa the current that flows from GND of the voltage clamp circuit 90 to the main discharge path X is adopted. Thus even if the diode D12 comes into an electrically disconnected state, by turning on the switching element S12, it is possible to allow the current to pass from GND of the voltage clamp circuit 90 to the main discharge path X via the diode connected to the switching element 6 in antiparallel and the switching element 12. For example, it is possible to quickly supply electric charges that cancels the negative voltage Vad accumulated in the main discharge path X from GND of the voltage clamp circuit 90 to the main discharge path X and to bring the potential of the main discharge path X to the potential equal to that of GND. Hence, it becomes possible to generate voltage waveforms for driving scan electrodes SC1 through SCn stably free of strain.

When the constant-voltage power supply V3 of negative voltage is not used for the reset waveform generation circuit 52, it is possible to configure a voltage clamp circuit without using the diode D12 and the switching element S12.

1-4 Modification Examples

1-4-1 Modification Example 1

Figure 5:
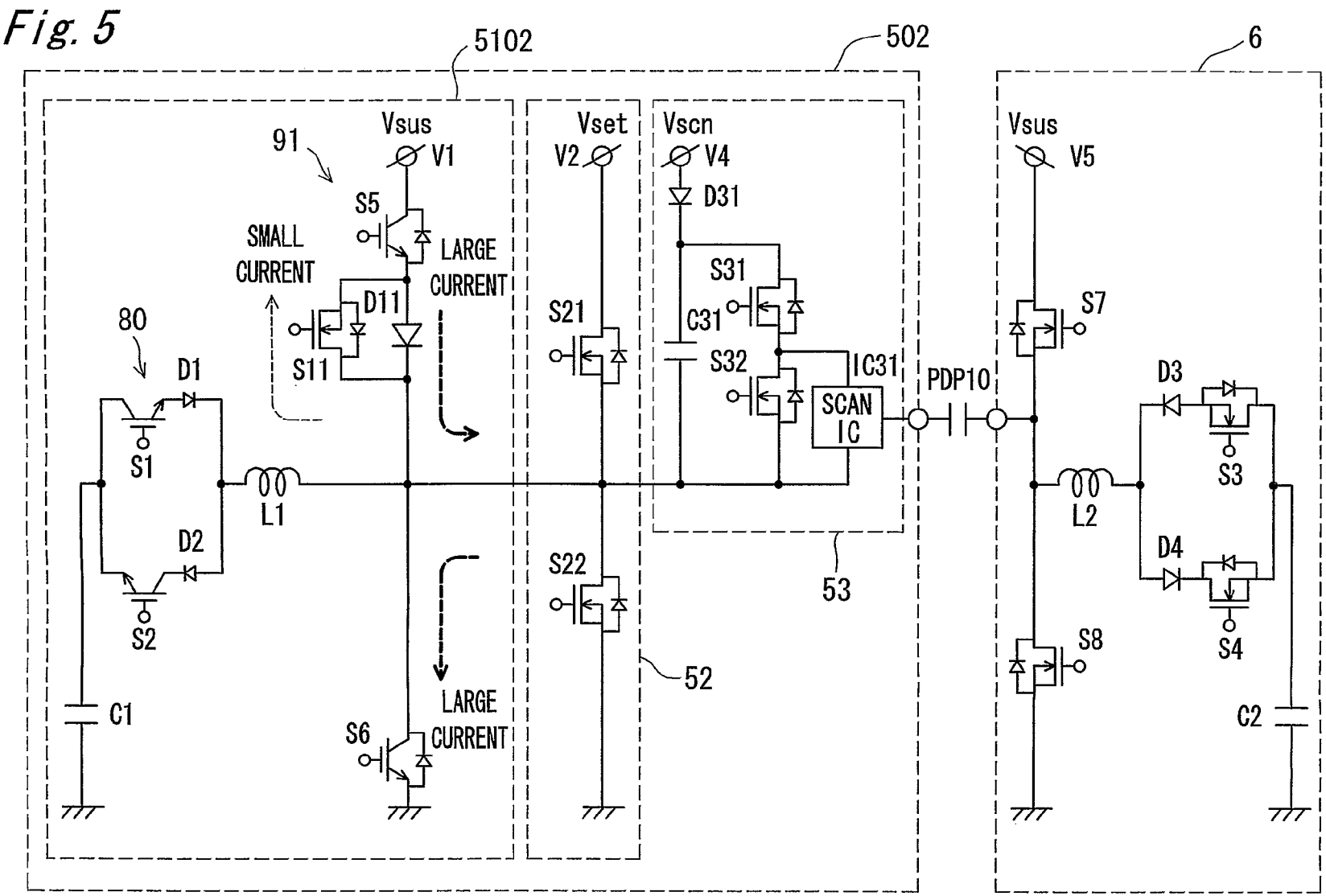
FIG. 5 is an illustration that indicates another example of the configuration of the PDP drive circuit.

FIG. 5 is an illustration that indicates another example of the configuration of PDP drive circuit in embodiment 1 of the present invention. The PDP drive circuit shown in FIG. 5 has a scan electrode drive circuit 502 and a sustain electrode drive circuit 6, and the scan electrode drive circuit 502 has a sustain pulse generation circuit 5102, a reset waveform generation circuit 52, and a scanning pulse generation circuit 53.

For example, as shown in FIG. 5, when there is no need to have negative voltage for generating the reset waveform and no constant-voltage power supply of negative potential is used for the reset waveform generation circuit 52, a voltage clamp circuit 91 of the sustain pulse generation circuit 5102 may be configured without using the diode D12 and the switching element S12 of FIG. 1. In this configuration, the same effects as described above can be obtained.

1-4-2 Modification Example 2

Figure 6:
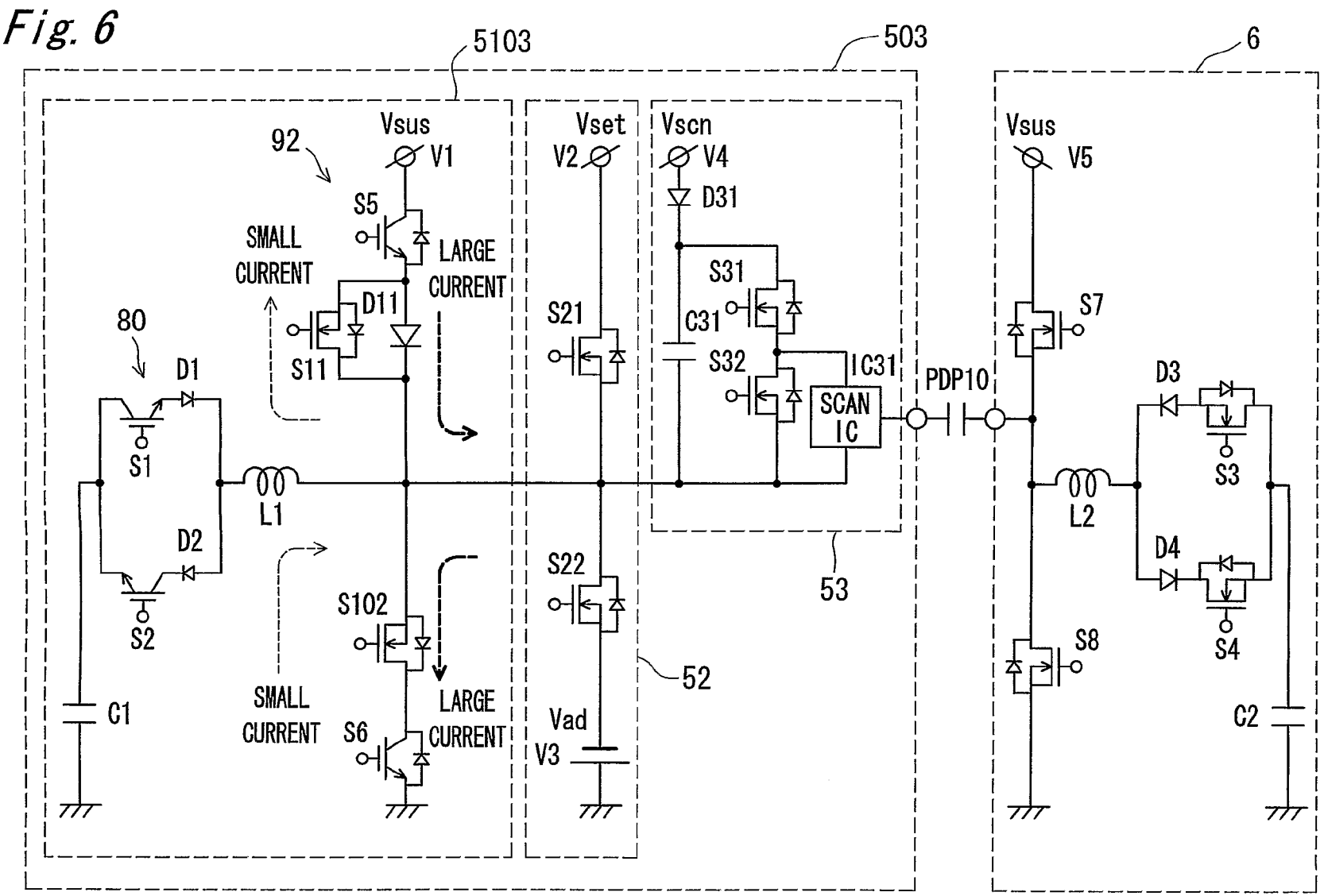
FIG. 6 is an illustration that indicates still another example of the configuration of the PDP drive circuit.

FIG. 6 is an illustration that indicates still another example of the configuration of the PDP drive circuit in embodiment 1. The PDP drive circuit shown in FIG. 6 is equipped with a scan electrode drive circuit 503 and the sustain electrode drive circuit, and the scan electrode drive circuit 503 has a sustain pulse generation circuit 5103, the reset waveform generation circuit 52, and the scan pulse generation circuit 53.

As shown in FIG. 6, it is possible to have a configuration using a switching element S102 by MOSFET, etc. same as prior art for the voltage clamp circuit 92 of the sustain pulse generation circuit 5103 in place of the diode D12 and switching element S12 of FIG. 1. Under this configuration, by changing over OFF from ON and vice versa of the switching element S102, it is possible to switch whether to shut off or pass the current flowing from GND of the voltage clamp circuit 92 to the main discharge path.

1-4-3 Modification Example 3

Figure 7:
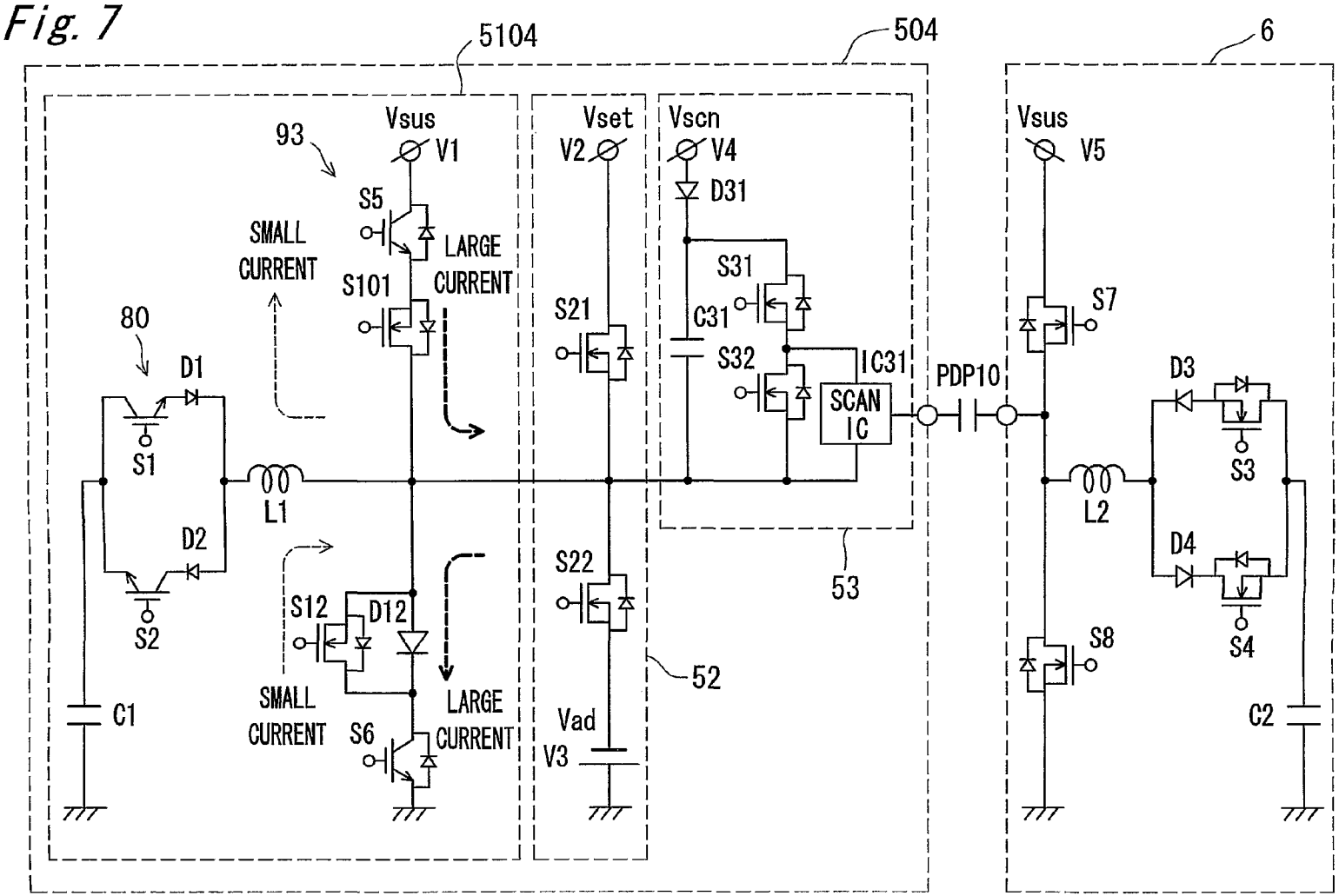
FIG. 7 is an illustration that indicates still another example of the configuration of the PDP drive circuit.

FIG. 7 is an illustration that indicates still another example of the configuration of PDP drive circuit in embodiment 1 of the present invention. The PDP drive circuit shown in FIG. 7 is equipped with a scan electrode drive circuit 504 and the sustain electrode drive circuit 6, and the scan electrode drive circuit 504 has a sustain pulse generation circuit 5104, the reset waveform generation circuit 52 and the scan pulse generation circuit 53.

As shown in FIG. 7, it is possible to have a configuration using a switching element S101 by MOSFET, etc. same as prior art for the voltage clamp circuit 93 of the sustain pulse generation circuit 5104 in place of the diode D11 and switching element S11 of FIG. 1. Under this configuration, by changing over OFF from ON and vice versa of the switching element S101, it is possible to switch whether to shut off or pass the current that flows from the main discharge path to the constant-voltage power supply V1.

As shown in modification examples 2 and 3, in place of either set of diode D11 and switching element S11 or set of diode D12 and switching element S12, the switching element S101 or S102 by MOSFET, etc. may be used, and under such configuration, the same effects as described above can be obtained.

1-4-4 Modification Example 4

Figure 8:
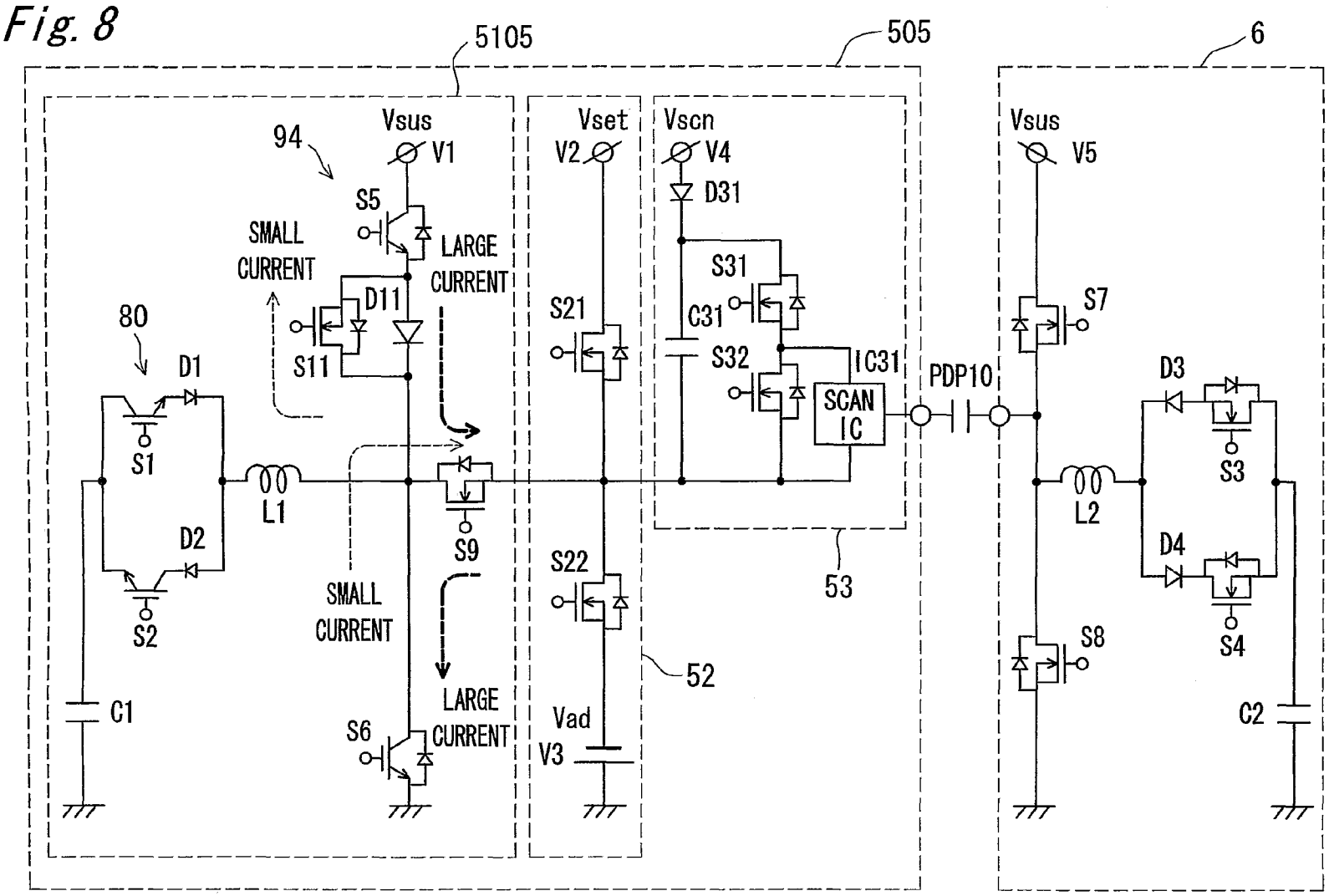
FIG. 8 is an illustration that indicates still another example of the configuration of the PDP drive circuit.

FIG. 8 is an illustration that shows still another example of the configuration of the PDP drive circuit in embodiment 1 of the present invention. The PDP drive circuit shown in FIG. 8 is equipped with a scan electrode drive circuit 505 and the sustain electrode drive circuit 6, and the scan electrode drive circuit 505 has a sustain pulse generation circuit 5105, the reset waveform generation circuit 52, and the scan pulse generation circuit 53.

As shown in FIG. 8, it is possible to have a configuration in which a switching element S9 by MOSFET, etc. same as prior art is installed on the main discharge path between the sustain pulse generation circuit 5105 and the reset waveform generation circuit 52 in place of the diode D12 and switching element S12 of FIG. 1. Under this configuration, by changing over OFF from ON and vice versa of the switching element S9, it is possible to switch whether to shut off or pass the current flowing from GND of the voltage clamp circuit 94 to the main discharge path.

1-4-5 Modification Example 5

Figure 9:
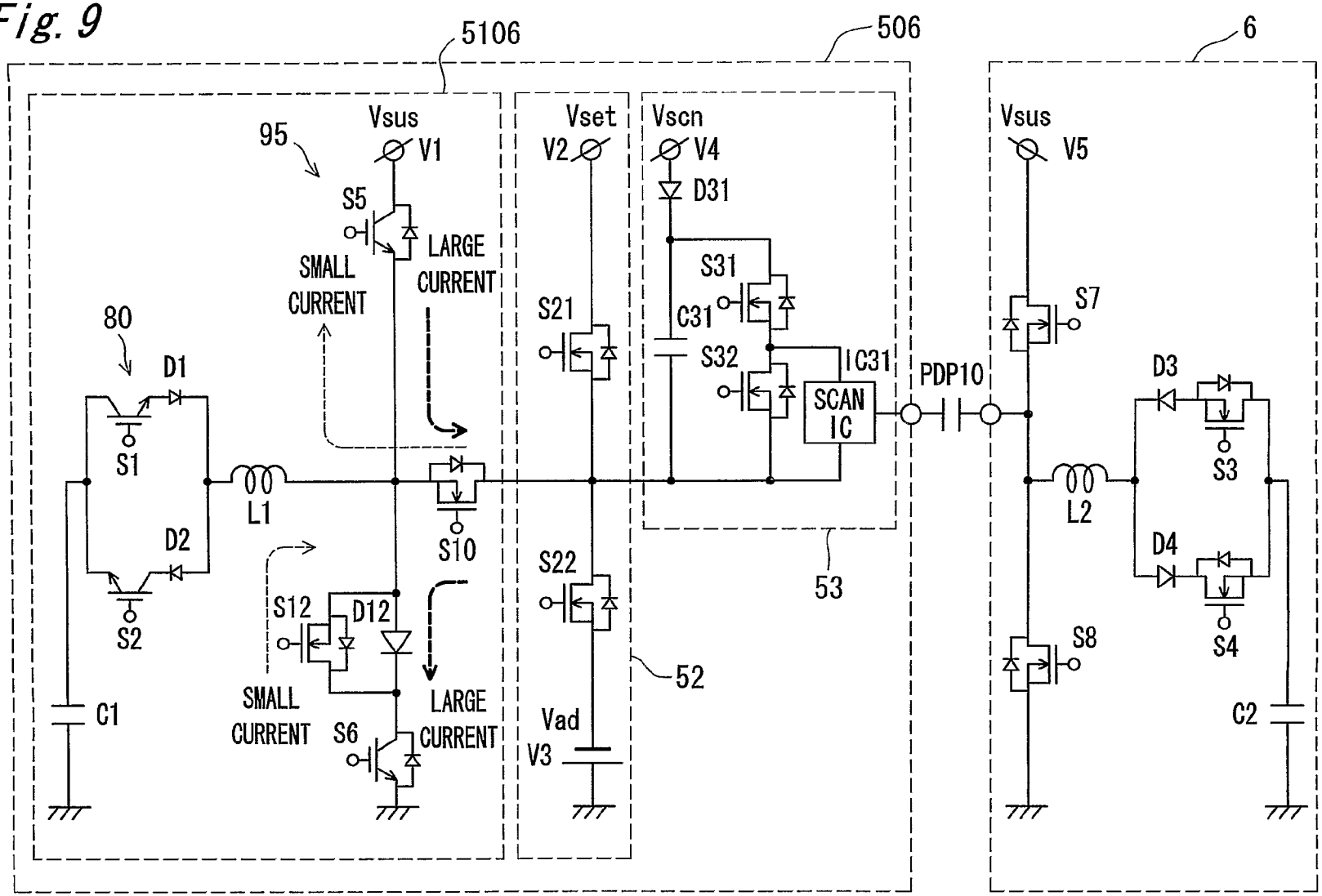
FIG. 9 is an illustration that indicates still another example of the configuration of the PDP drive circuit.

FIG. 9 is an illustration that indicates still another example of the configuration of the PDP drive circuit in embodiment 1 of the present invention. The PDP drive circuit shown in FIG. 9 is equipped with a scan electrode drive circuit 506 and the sustain electrode drive circuit 6, and the scan electrode drive circuit 506 has a sustain pulse generation circuit 5106, the reset waveform generation circuit 52 and the scan pulse generation circuit 53.

As shown in FIG. 9, it is possible to have a configuration in which a switching element S10 by MOSFET, etc. same as prior art is installed on the main discharge path between the sustain pulse generation circuit 5106 and the reset waveform generation circuit 52 in place of the diode D11 and switching element S11 of FIG. 1. Under this configuration, by changing over OFF from ON and vice versa of the switching element S10, it is possible to switch whether to shut off or pass the current that flows from the main discharge path to the constant-voltage power supply V1. In this way, in place of either set of diode D11 and switching element S11 or set of diode D12 and switching element S12, a switching element using MOSFET, etc. may be installed on the main discharge path between the sustain pulse generation circuit 5105 or 5106 and the reset waveform generation circuit 52.

1-4-6 Modification Example 6

Figure 10:
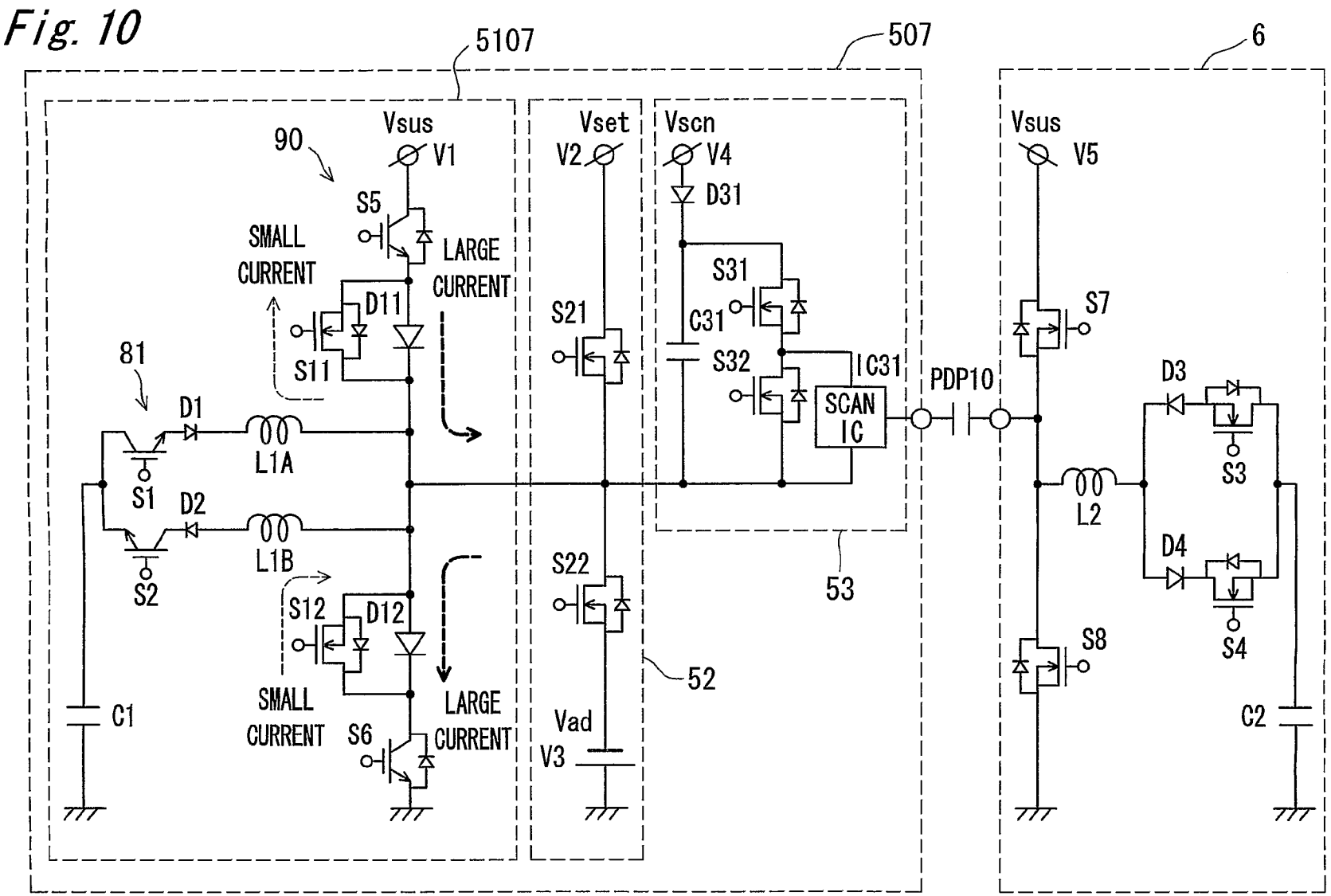
FIG. 10 is an illustration that indicates still another example of the configuration of the PDP drive circuit.

In the present embodiment, an example in which a coil for LC-resonance in the power recovery circuit is configured by the coil L1 only as shown in FIG. 1 and FIG. 5 through FIG. 9. However the present invention shall not be limited to this configuration. For example, in order to change resonance frequency, etc. at the time of electric power recovery and at the reuse, two coils may be used for the power recovery circuit, under which the same effects can be obtained. FIG. 10 is an illustration that indicates still another example of the configuration of the PDP drive circuit in embodiment 1. What differs in configuration shown in FIG. 10 from the configuration shown in FIG. 1 is that two coils, coil L1A and coil L1B, are used for the coil for LC-resonance in the power recovery circuit of the sustain pulse generation circuit 5107 in the scan electrode drive circuit 507. The coil L1B is used at the time of electric power recovery, and the coil L1A is used at the time of reusing electric power. For example, even when the power recovery circuit is configured in this way, the same effects as described above can be obtained. By the way, in FIG. 10, a configuration in which the coil L1A of the power recovery circuit 81 is connected to the cathode side of the diode D11 and the coil L1B is connected to the anode side of the diode D12 is shown. However, for example, a configuration in which the coil L1A is connected to the anode side of the diode D11 or coil L1B is connected to the cathode side of the diode D12 may be adopted. In addition, in configurations shown in FIG. 5 through FIG. 9, same as the configuration shown in FIG. 10, the configuration in which two coils are used for the power recovery circuit may be adopted.

1-4-7 Modification Example 7

Figure 11A:
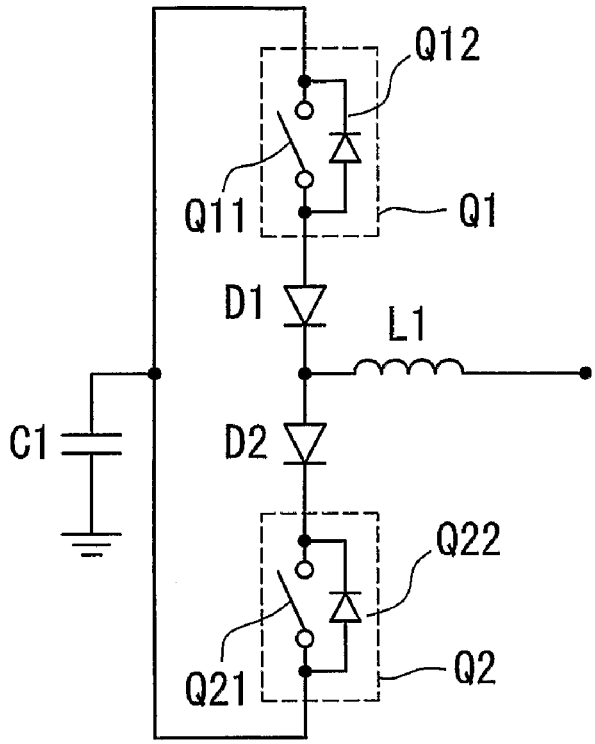
FIGS. 11A and 11B are illustrations that indicate other configuration examples of a power recovery circuit.
Figure 11B:
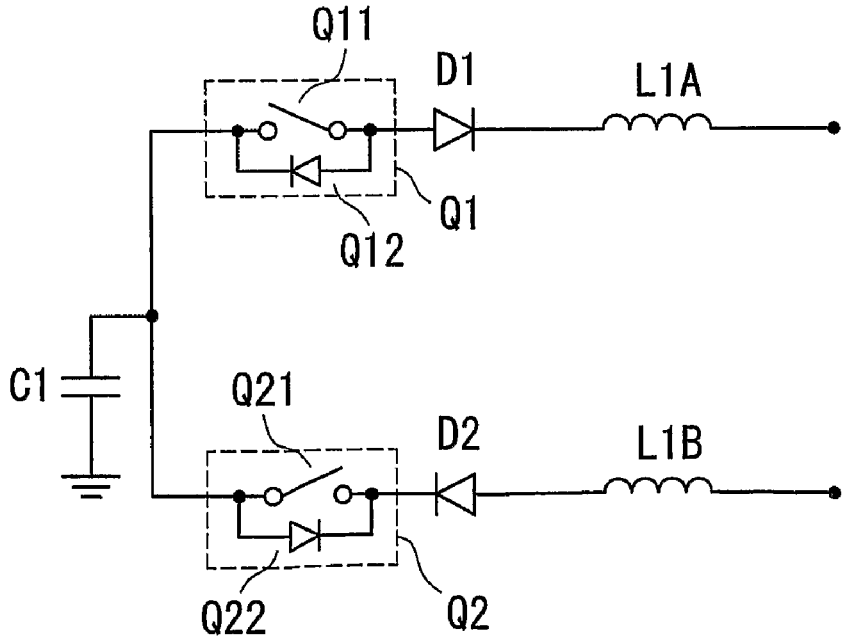

FIGS. 11A and 11B are figures that show another configuration examples of the power recovery circuit. The power recovery circuit shown in FIG. 11A has switching circuits Q1 and Q2 used in place of switching elements S1 and S2 in configurations of power recovery circuits of FIG. 1 and FIG. 5 through FIG. 9. The switching circuit Q1 is a parallel circuit of the switching element Q11 and the diode Q12. The switching circuit Q2 is a parallel circuit of the switching element Q21 and the diode Q22. The diode D1 and diode Q12 as well as the diode D2 and diode Q22 are back-to-back connected, respectively. Switching elements Q11 and Q21 are configured with MOSFET, IGBT, etc., and are properly selected in accord with specifications such as withstand voltage.

In addition, the power recovery circuit shown in FIG. 11B is a configuration in which two coils are used as is the case of FIG. 10. In the power recovery circuit shown in FIG. 11B, in the configuration of FIG. 10, switching circuits Q1 and Q2 composed of a parallel circuit of a switching element and a diode are used, respectively, in place of switching elements S1 and S2.

1-5 Plasma Display Apparatus

Figure 12:
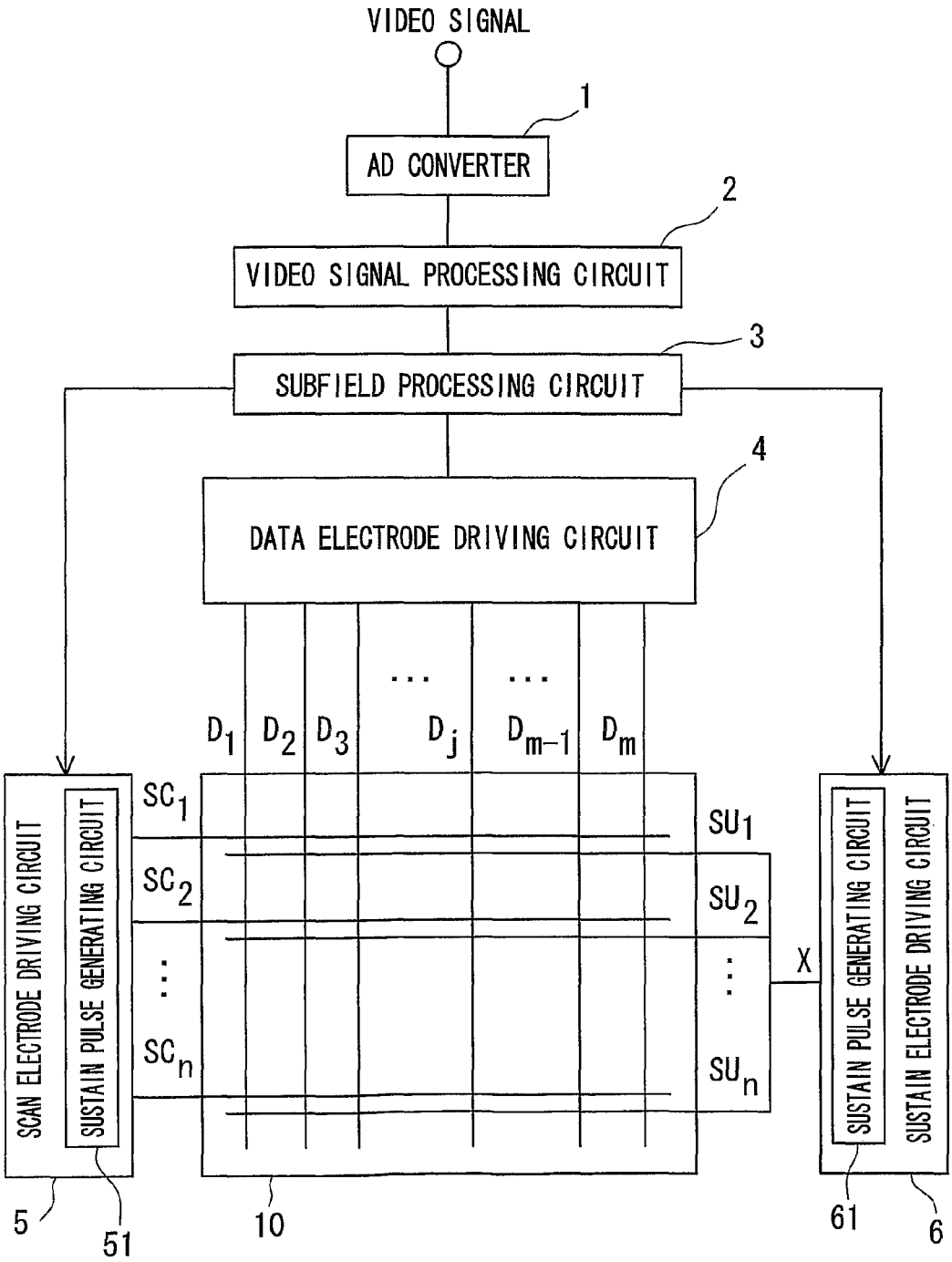
FIG. 12 is a block diagram that indicates electrical configuration of a plasma display apparatus with the PDP.

FIG. 12 is a block diagram that indicates a configuration of a plasma display apparatus with the PDP drive circuit according to the present embodiment incorporated.

The plasma display apparatus shown in FIG. 12 includes an AD converter 1, a video signal processing circuit 2, a subfield processing circuit 3, a data electrode drive circuit 4, a scan electrode drive circuit 5, a sustain electrode drive circuit 6, and a PDP 10.

The scan electrode drive circuit 5 and sustain electrode drive circuit 6 have the configuration and operation shown in FIG. 1 and FIG. 5 through FIG. 10.

The AD converter 1 converts the entered analog video signals into digital video signals. The video signal processing circuit 2 converts entered digital video signals into subfield data which carries out control of each subfield from 1-field video signal, in order to emit light and display entered digital video signals to the PDP 10 by combinations of a plurality of subfields with varying weights of light-emitting period.

The subfield processing circuit 3 generates a control signal for the data electrode drive circuit, a control signal for the scan electrode drive circuit, and a control signal for the sustain electrode drive circuit from subfield data prepared by the video signal processing circuit 2 and outputs them to the data electrode drive circuit 4, scan electrode drive circuit 5, and sustain electrode drive circuit 6, respectively.

The PDP 10 has n-rows of scan electrodes SC1 through SCn (scan electrode 22 of FIG. 2) and n-rows of sustain electrodes SU1 through SUn (sustain electrode 23 of FIG. 2) arranged alternately in the row direction and m-columns of data electrodes D1 through Dm (data electrode 32 in FIG. 2) arranged in the row direction as described above. (m×n) pieces of discharge cell Ci,j containing a pair of scan electrode SCi and sustain electrode SUi (i=1 through n) and one data electrode Dj (j=1 through m) are formed in the discharge space, and one pixel is configured by three discharge cells which emit light in each color of red, green, and blue.

The data electrode drive circuit 4 drives each data electrode Dj independently in accordance with the data electrode drive circuit control signals.

The scan electrode drive circuit 5 is equipped inside with a sustain pulse generation circuit 51 to emit sustain pulses applied to scan electrodes SC1 through SCn during the sustain period and can independently drive each scan electrode SC1 through SCn, respectively. In accordance with the scan electrode drive circuit control signals, the scan electrode drive circuit 5 independently drives each of scan electrodes SC1 through SCn.

The sustain electrode drive circuit 6 is equipped inside with a sustain pulse generation circuit 61 to generate sustain pulses applied to sustain electrodes SU1 through SUn during the sustain period, and can drive all the sustain electrodes SU1 through SUn of PDP 10 in bulk. In accordance with the sustain electrode drive circuit control signal, the sustain electrode drive circuit 6 drives sustain electrodes SU1 through SUn.

The PDP drive circuits shown in the following embodiments can be applied to the plasma display apparatus shown in FIG. 12, too.

Embodiment 2

2-1 Configuration of PDP Drive Circuit

Figure 13:
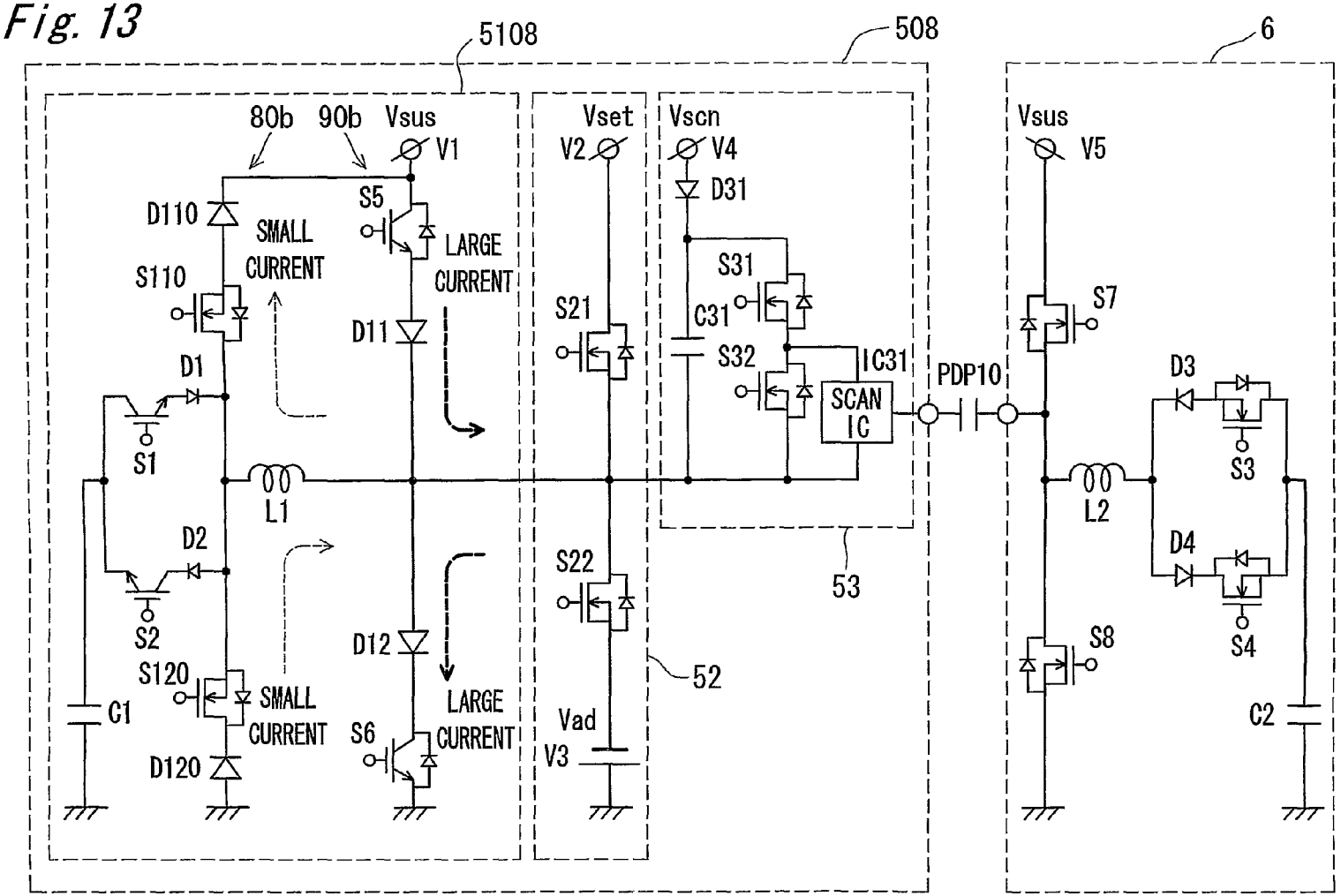
FIG. 13 is an illustration which indicates a PDP drive circuit configuration in embodiment 2 of the present invention.

FIG. 13 is an illustration that indicates a configuration of PDP drive circuit in embodiment 2 of the present invention. Structure and electrode arrangement of PDP which the PDP drive circuit in the present embodiment is subject to drive, each drive voltage waveform which the PDP drive circuit in the present embodiment applies to each electrode of PDP 10, and electrical configuration of a plasma display apparatus in which the PDP drive circuit and PDP 10 of the present embodiment are same as those of embodiment 1. Thus descriptions on the relevant configuration and operation will be omitted.

As shown in FIG. 13, the PDP drive circuit in embodiment 2 of the present invention is equipped with a scan electrode drive circuit 508 and the sustain electrode drive circuit 6 which have power recovery circuits. The scan electrode drive circuit 508 has a sustain pulse generation circuit 5108, reset waveform generation circuit 52, and scan pulse generation circuit 53. Because the reset waveform generation circuit 52 and scan pulse generation circuit 53 are the same as the reset waveform generation circuit 52 of the scan electrode drive circuit 501 and the scan pulse generation circuit 53 shown in FIG. 1, description of the relevant configurations and operations will be omitted.

The sustain pulse generation circuit 5108 shown in FIG. 13 includes a power recovery circuit 80*b* and a voltage clamp circuit 90*b*, and the power recovery circuit 80*b* contains a coil L1, a recovery capacitor C1, switching elements S1 and S2 and reverse blocking diodes D1 and D2. The power recovery circuit 80*b* includes a diode D110 which is a third diode that shuts off current flowing from the constant-voltage power supply V1 to the main discharge path, a switching element S110 as a third switch which can be changed over between shutting off or passing the current which flows into the constant-voltage power supply V1 connected to the diode D110 in series, a diode D120 as a fourth diode which shuts off the current backflowing from the main discharge path to GND of the voltage clamp circuit 90*b*, and a switching element S120 as a forth switch that can change over between shutting off or passing the current flowing from GND of the voltage clamp circuit connected to the diode D120 in series to the main discharge path via the diode D120.

In addition, the voltage clamp circuit 90*b* includes a switching element S5 which is a power supply clamp switch, a switching element S6 which is a ground clamp switch, a constant-voltage power supply V1 of the voltage Vsus which is a first power supply, a diode D11 as a first diode that is connected to the switching element S5 in series and shuts off current flowing into the constant-voltage power supply V1, and a diode D12 which is a second diode that is connected to the switching element S6 in series and shuts off current flowing from GND of the voltage clamp circuit to the main discharge path via the switching element S6.

In the sustain pulse generation circuit 5108, the power recovery circuit 80*b* has a configuration in which a diode D110 and a switching element S110 connected in series are connected in parallel to the switching element S5 and the diode D11 in series with the coil L1 interposed between them, a diode D120 and a switching element S120 connected in series are connected in parallel to the switching element S6 and the diode D12 connected in series with the coil L1 interposed between them.

The point that the sustain pulse generation circuit 5108 shown in FIG. 13 differs from the sustain pulse generation circuit 5101 shown in FIG. 1 is that in place of the switching element S11 connected to the diode D11 in parallel and the switching element S12 connected to the diode D12 in parallel, the diode D110 and the switching element S110 as well as the diode D120 and the switching elements S110 and S120 are included, respectively.

In addition, the sustain pulse generation circuit 5108 shown in FIG. 13 and the sustain pulse generation circuit 5101 shown in FIG. 1 carry out practically same operations. That is, in the sustain pulse generation circuit 5108, by changing over switching elements S1, S2, S5, S6, S110, and S120, the power recovery circuit 80*b* and the voltage clamp circuit 90*b* are changed over, and thus sustain pulses to apply to scan electrodes SC1 through SCn are generated. In the power recovery circuit 80*b*, by use of the coil L1 which is an inductance element, the capacitive load of PDP 10 (capacitive load generated in scan electrodes SC1 through SCn of FIG. 3) and inductance of the coil L1 are LC-resonated to recover and supply the electric power. In the voltage clamp circuit 90*b*, the electric power is supplied from the constant-voltage power supply V1 of the voltage Vsus to scan electrodes SC1 through SCn via the switching element S5 and the diode D11 to clamp scan electrodes SC1 through SCn to the voltage Vsus, and by clamping scan electrodes SC1 through SCn to the grounding potential via the diode D12 and the switching element S6, scan electrodes SC1 through SCn are driven.

2-2 Operation of the PDP Drive Circuit

The PDP drive circuit operation will be discussed with particular emphasis on the operation of switching elements S110 and S120. The drive voltage waveforms applied during the reset period, address period, and sustain period are as per shown in FIG. 4.

2-2-1 Reset Period

First of all, description will be made on the operation of switching elements S110 and S120 during the reset period, that is, a period when scan electrodes SC1 through SCn are driven by the reset waveform generation circuit 52.

In the voltage clamp circuit 90*b* of the sustain pulse generation circuit 5108, the diode D11 is disposed in the direction to shut off the current flowing into the constant-voltage power supply V1, and the switching element S110 is disposed in the direction in such a manner as for its body diode to shut off the current flowing into the constant-voltage power supply V1.

By having this configuration, turning off the switching element S110 can electrically separate the constant-voltage power supply V1 from the reset waveform generation circuit 52. By this, when scan electrodes SC1 through SCn are driven by the constant-voltage power supply V2 with higher potential than the constant-voltage power supply V1, the current flowing from the constant-voltage power supply V2 to the constant-voltage power supply V1 can be shut off and voltage drop of the main discharge path and strain of drive waveform generated as a result of it can be prevented.

In addition, in the voltage clamp circuit 90*b* of the sustain pulse generation circuit 5108, the diode D12 is disposed in the direction to shut off the current flowing from GND of the voltage clamp circuit 90*b* to the main discharge path and the switching element S120 is disposed in the direction in such a manner as for its body diode to shut off the current flowing from GND to the main discharge path.

By having this configuration, turning off the switching element S120 can electrically separate GND of the voltage clamp circuit 90*b* from the reset waveform generation circuit 52. Thus, when scan electrodes SC1 through SCn are driven by the constant-voltage power supply V3 with negative potential, the current flowing from GND of the voltage clamp circuit 90*b* to the constant-voltage power supply V3 can be shut off, and voltage increase of the main discharge path and strain of drive waveform generated as a result of it can be prevented.

Consequently, in the first half portion of the reset period, switching elements S110 is off to separate electrically the constant-voltage power supply V1 from the main discharge path so that the reset waveform generation circuit 52 is allowed to stably generate slope waveforms which slowly increase voltage Vi1 to voltage Vi2, that is, voltage Vset.

On the other hand, when the potential of the main discharge path reaches the voltage Vset by electric power supply from the constant-voltage power supply V2, while the anode-side potential of the diode D11 is equal to the voltage Vsus by the constant-voltage power supply V1, the cathode-side potential of the diode 11 becomes the voltage Vset which is higher than the voltage Vsus. This results in the electrically disconnected condition where the current is prevented from flowing from the anode side to the cathode side of the diode D11. As described above, in the reset waveform in the present embodiment, voltage must be quickly lowered from voltage Vi2 to voltage Vi3 as soon as the first half portion of the reset period is finished. For example, when voltage Vi3 is equal to the voltage Vsus, it is possible to quickly bring the main discharge path to the potential same as the constant-voltage power supply V1 by connecting the constant-voltage power supply V1 to electrically to the main discharge path and to lower the reset waveform from voltage Vi2 to voltage Vi3. However, once the diode D11 is brought into the electrically disconnected condition, it is no longer possible to quickly bring the main discharge path to the potential same as that of constant-voltage power supply V1, and it becomes difficult to generate normal drive waveform.

Therefore, in the present embodiment, as soon as the first half of the reset period is finished, the switching elements S110 and S5 are turned on. By doing this, the constant-voltage power supply V1 is connected electrically to the main discharge path, and electric charges accumulated in the main discharge path are able to be transferred to the constant-voltage power supply V1 via the coil L1, the switching element S110 and the diode D110. Thus the potential of the main discharge path can be quickly brought to the potential same as that of the constant-voltage power supply V1. In such event, the current that flows in the switching element S110 is primarily attributed to charges accumulated in the main discharge path and forms a comparatively small current. Consequently, the switching element S110 may be of the size that enables this current to flow and is able to be configured with reduced number of elements such as MOSFET with comparatively small rated value.

In this way, in the second half of the reset period, first of all, the switching element S110 is turned on and the potential of reset waveform is quickly lowered to voltage Vi3. Thereafter, the switching elements S5, S120 are turned off and the constant-voltage power supply V1 and GND are electrically separated from the main discharge path, thereby allowing the reset waveform generation circuit 52 to stably generate slope waveforms which gradually lowers from voltage Vi3 to voltage Vi4, that is, to the negative voltage Vad.

2-2-2 Address Period

Next description will be made on the operation of switching elements S110 and S120 during the address period, that is, the period for which scan electrodes SC1 through SCn are driven by the scan pulse generation circuit 53.

As described above, in the drive waveforms of scan electrodes SC1 through SCn in the present embodiment, as soon as the second half of the reset period is finished, the switching element S31 of the scan pulse generation circuit 53 is turned on, and the electric power of the voltage Vscn is supplied to SC1 through SCn via IC31 which carries out switching operation. Thus, the drive waveforms applied to scan electrodes SC1 through SCn quickly rise from the voltage Vi4 to the voltage Vscn as soon as the second half of the reset period is finished.

On the other hand, in the address period, in order to successively apply negative scan pulses to all the scan electrodes SC1 through SCn, the switching element S22 of the reset waveform generation circuit 52 is turned on to connect electrically the constant-voltage power supply V3 to the main discharge path. In addition, the constant-voltage power supply V1 and GND of voltage clamp circuit 90*b* is electrically separated from the main discharge path by turning off the switching element S32 of the scan pulse generation circuit 53 and turning off the switching elements S110 and S120 of the sustain pulse generation circuit 5108. Further, the constant-voltage power supply V2 is electrically separated from the main discharge path by turning off the switching element S21 of the reset waveform generation circuit 52. Hence the potential of the main discharge path is kept at negative voltage Vad. In this way, IC31 supplies the electric power from the constant-voltage power supply V3 to scan electrodes SC1 through SCn in a timing of applying negative scan pulses, or supplies the electric power from the constant-voltage power supply V4 to scan electrodes SC1 through SCn in other occasions.

2-2-3 Sustain Period

Next description will be made on the operations of switching elements S110 and S120 during the sustain period, that is, the period for which scan electrodes SC1 through SCn are driven by the sustain pulse generation circuit 5108.

As described above, in drive waveforms of scan electrodes SC1 through SCn in the present embodiment, the drive voltage is brought temporarily to 0 (V) when the address period is finished.

However, when the potential of the main discharge path becomes the negative voltage Vad by electric power supply from the constant-voltage power supply V3, the potential on the cathode side of the diode D12 is made 0 (V) by GND of the voltage clamp circuit 90*b*, whereas the anode-side potential becomes the negative voltage Vad lower than 0(V) and the electrically blocked-out condition results in which no current is allowed to flow from anode side to cathode side of diode D12. In order to make the main discharge path be 0 (V), GND of the voltage clamp circuit should be connected electrically to the main discharge path, but when the diode D12 comes into the electrically blocked out condition, the main discharge path is unable to be quickly brought to 0 (V) and it becomes difficult to generate normal drive waveforms.

Therefore, in the present embodiment, as soon as the address period is finished, the switching element S120 and the switching element S6 are turned on. By doing so, GND of the voltage clamp circuit 90*b* is connected electrically to the main discharge path, electric charges from GND of the voltage clamp circuit are supplied to the main discharge path via the diode D120, the switching element S120, and the coil L1 in such a manner as to cancel negative electric charges accumulated in the main discharge path, and the potential of the main discharge path quickly becomes 0 (V). The current that flows the switching element S120 in such event becomes a comparatively small current that is enough to cancel negative electric charges accumulated in the main discharge path. Consequently, the switching element S120 may be of a size that can allow this current to flow, and can be configured by reduced number of elements, such as MOSFET, with comparatively small rated value.

After the potential of the main discharge path becomes 0 (V), by controlling switching elements S1, S2, 5, and S6 in the way as prior art, when the electric power is recovered, the electric power accumulated in the capacitive load generated in scan electrodes SC1 through SCn is transferred to a recovery capacitor C1 via the reverse blocking diode D2 and switching element S2. When the electric power is supplied, the electric power accumulated in the recovery capacitor C1 can be transferred to scan electrodes SC1 through SCn via the switching element S1 and reverse blocking diode D1. In addition, at the time of clamping, the electric power is supplied from the constant-voltage power supply V1 of a voltage Vsus to scan electrodes SC1 through SCn via the switching element S5 and diode D11, and the electric power accumulated in the capacitive load generated in scan electrodes SC1 through SCn is discharged to GND via the diode D12 and switching element S6.

In such event, when it is configured that the rise of sustain pulse by the sustain pulse generation circuit 5108 takes place after the fall of the sustain pulse by the sustain electrode drive circuit 6, at least the switching element S120 is kept on during the sustain pulse down period. In addition, during the sustain period for which the switching element S5 is on, the switching element S110 is kept on. In addition, it is configured that the fall of the sustain pulse by the sustain pulse generation circuit 5108 takes place before the rise of the sustain pulse by the sustain electrode drive circuit 6, at least the switching elements S120 is kept on during the sustain pulse up period. During other sustain periods, switching elements S110 and S120 may be on or off, whichever is acceptable. Thus, it is possible to have down-waveforms free of strain. When it is configured to simultaneously carry out fall of sustain pulses by the sustain electrode drive circuit 6 and rise of sustain pulses by the sustain pulse generation circuit 5108, the switching element S120 is turned off during the period of fall of sustain pulses by the sustain electrode drive circuit 6. In addition, when it is configured to simultaneously carry out rise of sustain pulses by the sustain electrode drive circuit 6 and fall of sustain pulses by the sustain pulse generation circuit 5108, similarly the switching element S120 is turned off during the down period of sustain pulse of the sustain electrode drive circuit 6. Other operations during other sustain period take place as described above.

2-3 Effects

As described above, according to the present embodiment, having a configuration to provide diodes D11 and D12 to the voltage clamp circuit 90*b* of the sustain pulse generation circuit 5108 can electrically separate the constant-voltage power supply V1 and GND of the voltage clamp circuit 90*b* from the main discharge path without disposing a switching element between the sustain pulse generation circuit 5108 and the reset waveform generation circuit 52. Consequently, it is possible to reduce impedance in the main discharge path from the coil L1 of the power recovery circuit to scan electrodes SC1 through SCn, to improve the recovery ratio of electric power accumulated in the capacitive load of PDP 10, thereby achieving reduction of power consumption.

Furthermore, since a drive circuit can be configured by the use of diodes with large rated values. Thus, as compared to the case in which MOSFETs and other switching elements are used, the number of elements that compose the drive circuit can be reduced.

Furthermore, since a configuration with the switching element S110 and diode D110 which are able to switch from shutting off or passing or vice versa the current that flows from the main discharge path to the constant-voltage power supply V1 and diode D110 are connected in series, and the switching element 5 and diode D11 which are connected in series are disposed in parallel to the switching element S110 and diode D120 via the coil L1 is adopted, it is possible to allow the current from the main discharge path to the constant voltage power supply V1 via the switching element S110 and diode D110, even if the diode D11 is disconnected electrically. For example electric charge of the voltage Vset accumulated in the main discharge path can be quickly transferred to the constant-voltage power supply V1 to bring the potential of the main discharge path to the potential equal to that of the constant-voltage power supply V1.

In addition, it is configured that the switching element S120 and a diode D120 which can switch from shutting off or passing the current that flows from GND of the voltage clamp circuit 90*b* to the main discharge path are connected in series and a switching element S6 and diode D12 which are connected in series are connected to the switching element S120 and diode D120 in parallel via the coil L1. Thus, even if the diode D12 comes into an electrically shut off state, it is possible to allow the current to pass from GND to the main discharge path via the switching element S120 and the diode D120. For example, it is possible to quickly supply electric charges that cancels the negative voltage Vad accumulated in the main discharge path from GND of the voltage clamp circuit 90*b* to the main discharge path and to bring the potential of the main discharge path to the potential equal to that of GND. Accordingly, it becomes possible to generate voltage waveforms for driving scan electrodes SC1 through SCn stably free of strain.

When the constant-voltage power supply V3 of negative voltage is not used for the reset waveform generation circuit 52, it is possible to configure a voltage clamp circuit without using the diode D120 and the switching element S120.

2-4 Modification Examples 2-4-1 Modification Example 1

Figure 14:
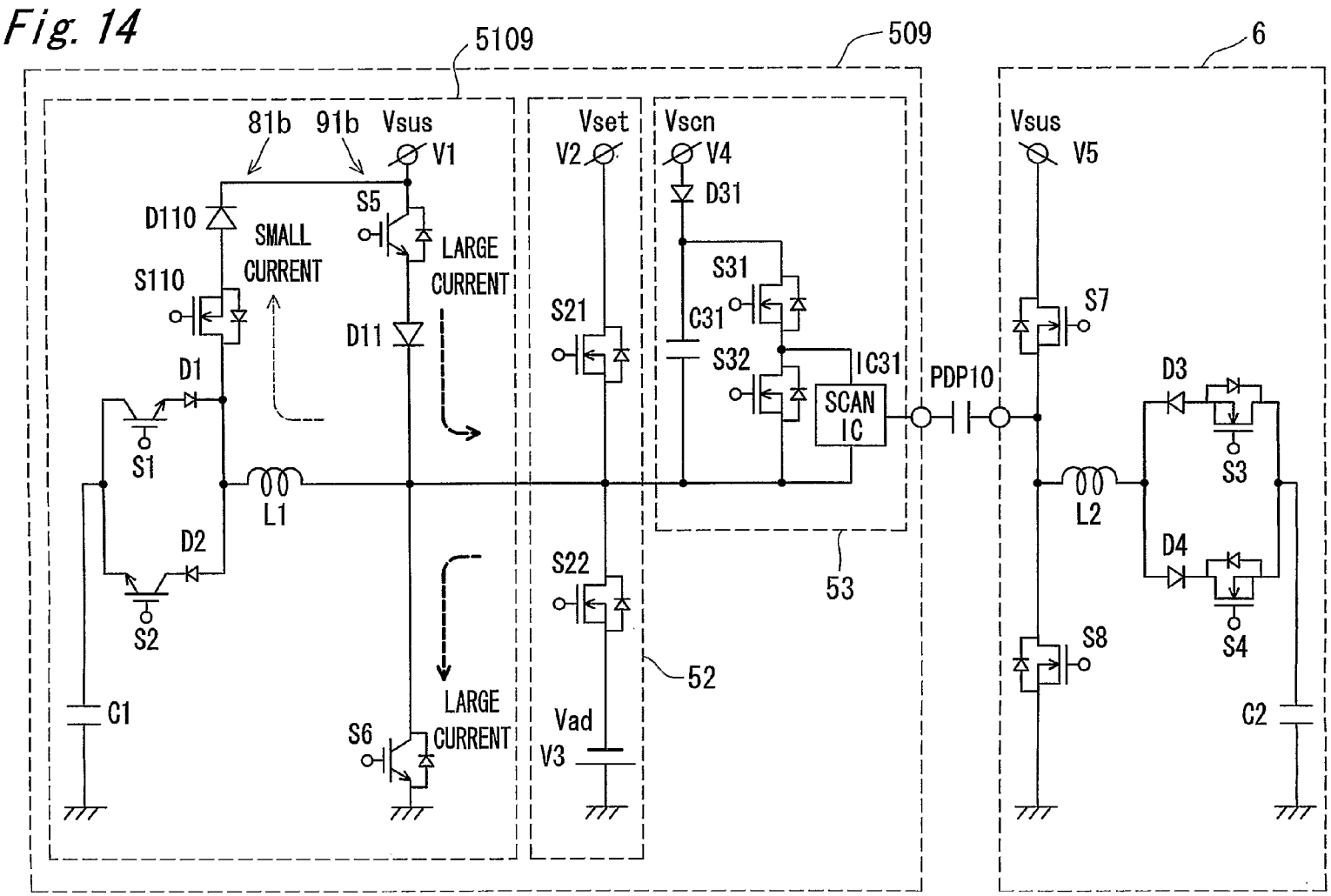
FIG. 14 is an illustration that indicates another example of the PDP drive circuit configuration.

FIG. 14 is an illustration that indicates another example of the configuration of PDP drive circuit in embodiment 2 of the present invention. The PDP drive circuit shown in FIG. 14 has a scan electrode drive circuit 509 and a sustain electrode drive circuit 6, and the scan electrode drive circuit 509 has a sustain pulse generation circuit 5109, a reset waveform generation circuit 52, and a scanning pulse generation circuit 53.

When there is no need to apply negative voltage at the time of generating the reset waveform and no constant-voltage power supply with negative potential is used for the reset waveform generation circuit 52, as shown in FIG. 14, a voltage clamp circuit 91*b* of the sustain pulse generation circuit 5109 may be configured without using the diode D120 and the switching element S120 of FIG. 13. Even in this configuration, the same effects as described above can be obtained.

2-4-2 Modification Example 2

Figure 15:
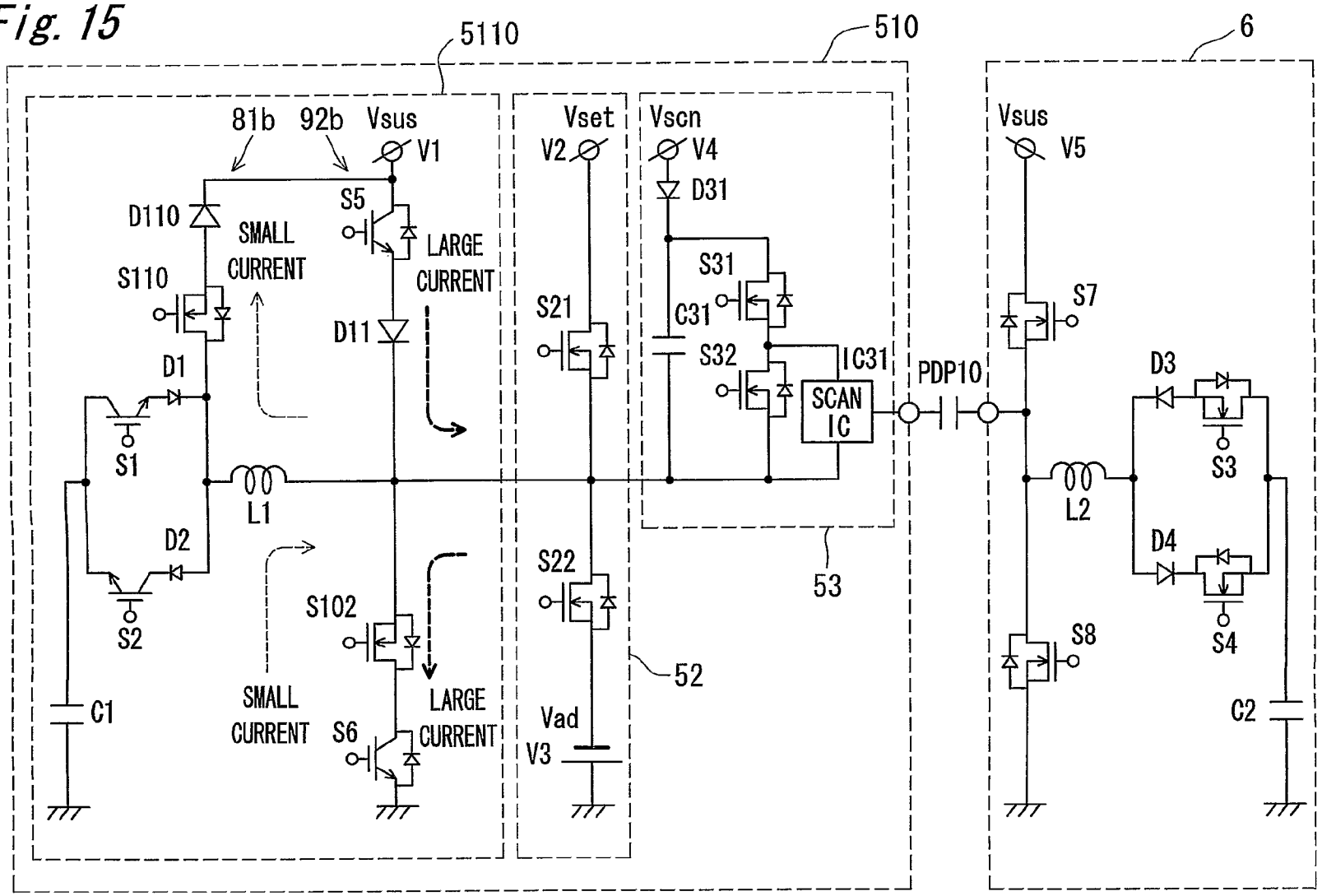
FIG. 15 is an illustration that indicates still another example of the PDP drive circuit configuration.

FIG. 15 is an illustration that indicates still another example of the configuration of the PDP drive circuit in embodiment 2. The PDP drive circuit shown in FIG. 15 is equipped with a scan electrode drive circuit 510 and the sustain electrode drive circuit 6, and the scan electrode drive circuit 510 has a sustain pulse generation circuit 5110, the reset waveform generation circuit 52, and the scan pulse generation circuit 53.

As shown in FIG. 15, it is possible to have a configuration using a switching element S102 by MOSFET, etc. same as prior art for the voltage clamp circuit 92*b* of the sustain pulse generation circuit 5110 in place of the diode D120 and switching element S120 of FIG. 13. Under this configuration, by changing over OFF from ON and vice versa of the switching element S102, it is possible to switch whether to shut off or pass the current flowing from GND of the voltage clamp circuit 92*b* to the main discharge path.

2-4-3 Modification Example 3

Figure 16:
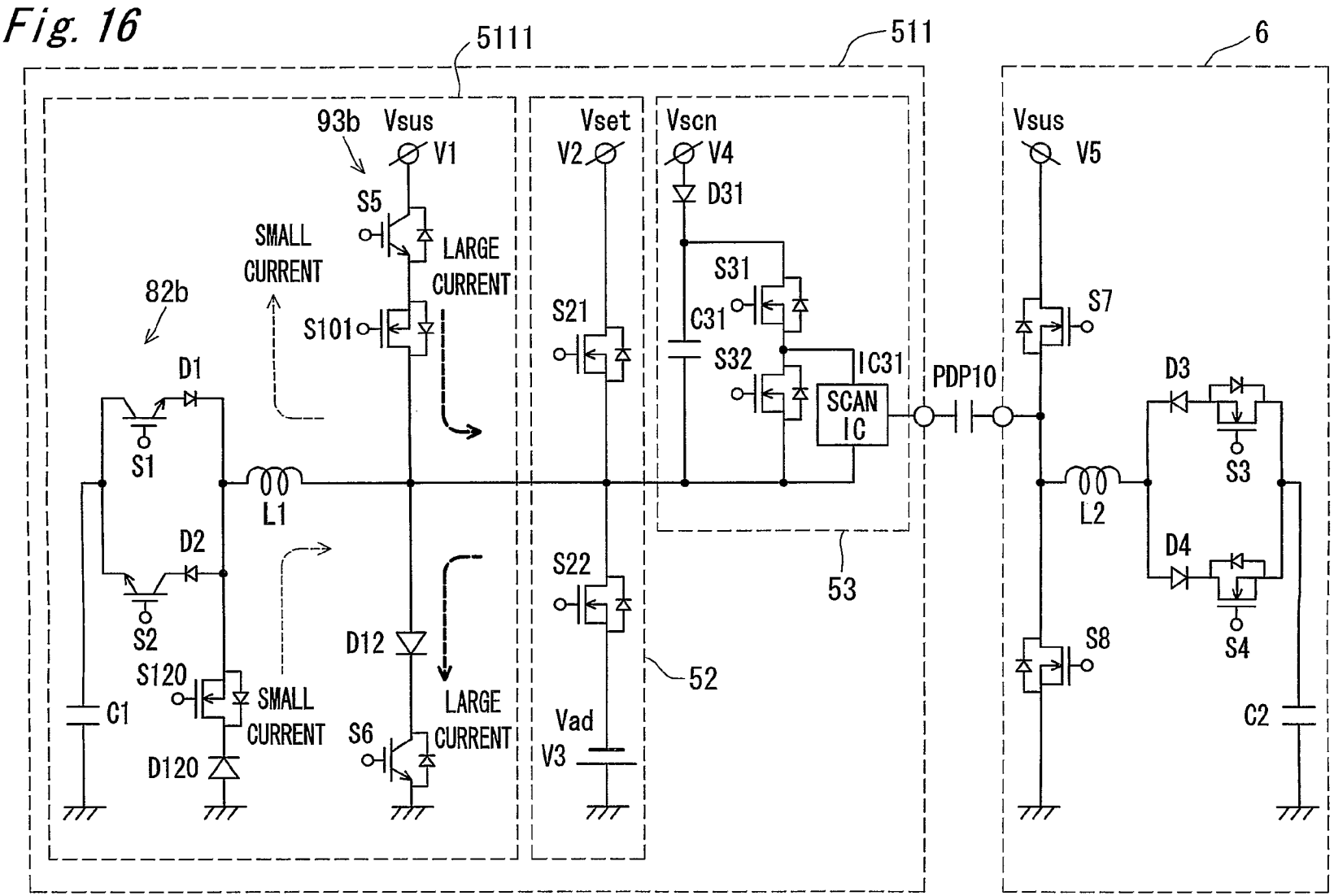
FIG. 16 is an illustration that indicates still another example of the PDP drive circuit configuration.

FIG. 16 is an illustration that indicates still another example of the configuration of the PDP drive circuit in embodiment 2 of the present invention. The PDP drive circuit shown in FIG. 16 is equipped with a scan electrode drive circuit 511 and the sustain electrode drive circuit 6, and the scan electrode drive circuit 511 has a sustain pulse generation circuit 5111, the reset waveform generation circuit 52 and the scan pulse generation circuit 53.

As shown in FIG. 16, it is possible to have a configuration using a switching element S101 by MOSFET, etc. same as prior art for the voltage clamp circuit 93*b* of the sustain pulse generation circuit 5111 in place of the diode D110 and switching element S110 of FIG. 13. Under this configuration, by changing over OFF from ON and vice versa of the switching element S101, it is possible to switch whether to shut off or pass the current that flows from the main discharge path to the constant-voltage power supply V1.

As shown in modification examples 2 and 3, in place of either set of diode D110 and switching element S110 or set of diode D120 and switching element S120, the switching element S101 or S102, such as MOSFET, may be used. Even under such configuration, the same effects as described above can be obtained.

2-4-4 Modification Example 4

Figure 17:
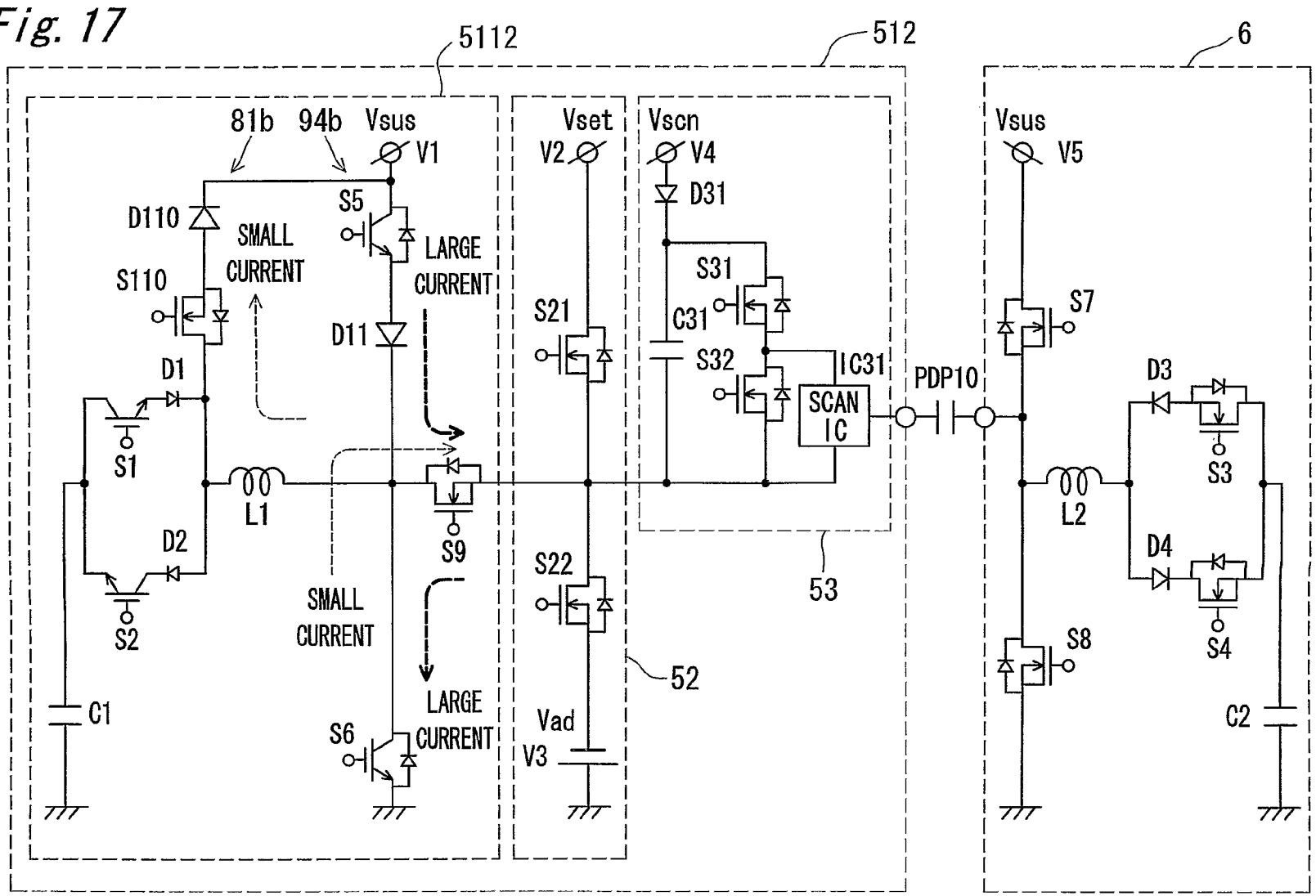
FIG. 17 is an illustration that indicates still another example of the PDP drive circuit configuration.

FIG. 17 is an illustration that shows still another example of the configuration of PDP drive circuit in embodiment 2 of the present invention. The PDP drive circuit shown in FIG. 17 is equipped with a scan electrode drive circuit 512 and the sustain electrode drive circuit 6, and the scan electrode drive circuit 512 has a sustain pulse generation circuit 5112, the reset waveform generation circuit 52, and the scan pulse generation circuit 53.

As shown in FIG. 17, it is possible to have a configuration in which a switching element S9, such as MOSFET, same as prior art is installed on the main discharge path between the sustain pulse generation circuit 5112 and the reset waveform generation circuit 52 in place of the diode D120 and switching element S120 of FIG. 13. Under this configuration, by changing over OFF from ON and vice versa of the switching element S9, it is possible to switch whether to shut off or pass the current flowing from GND of the voltage clamp circuit to the main discharge path.

2-4-5 Modification Example 5

Figure 18:
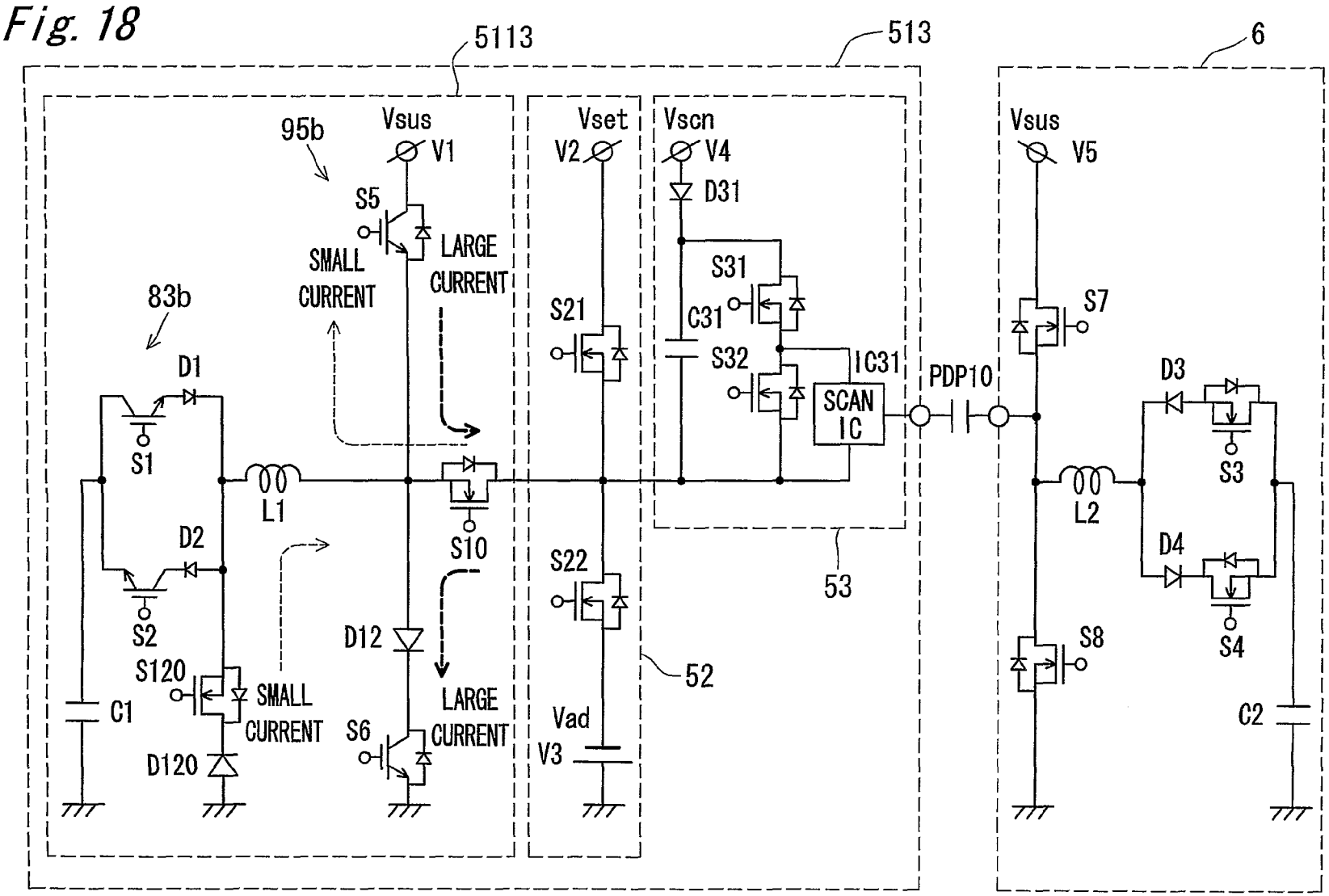
FIG. 18 is an illustration that indicates still another example of the PDP drive circuit configuration.

FIG. 18 is an illustration that indicates still another example of the configuration of PDP drive circuit in embodiment 2 of the present invention. The PDP drive circuit shown in FIG. 18 is equipped with a scan electrode drive circuit 513 and the sustain electrode drive circuit 6, and the scan electrode drive circuit 513 has a sustain pulse generation circuit 5113, the reset waveform generation circuit 52 and the scan pulse generation circuit 53.

As shown in FIG. 18, it is possible to have a configuration in which a switching element S10, such as MOSFET, same as prior art is installed on the main discharge path between the sustain pulse generation circuit 5113 and the reset waveform generation circuit 52 in place of the diode D110 and switching element S110 of FIG. 13. Under this configuration, by changing over OFF from ON and vice versa of the switching element S10, it is possible to switch whether to shut off or pass the current that flows from the main discharge path to the constant-voltage power supply V1. In this way, in place of either set of diode D110 and switching element S110 or set of diode D120 and switching element S120, a switching element using MOSFET, etc. may be installed on the main discharge path between the sustain pulse generation circuit 5112 or 5113 and the reset waveform generation circuit 52.

2-4-6 Modification Example 6

Figure 19:
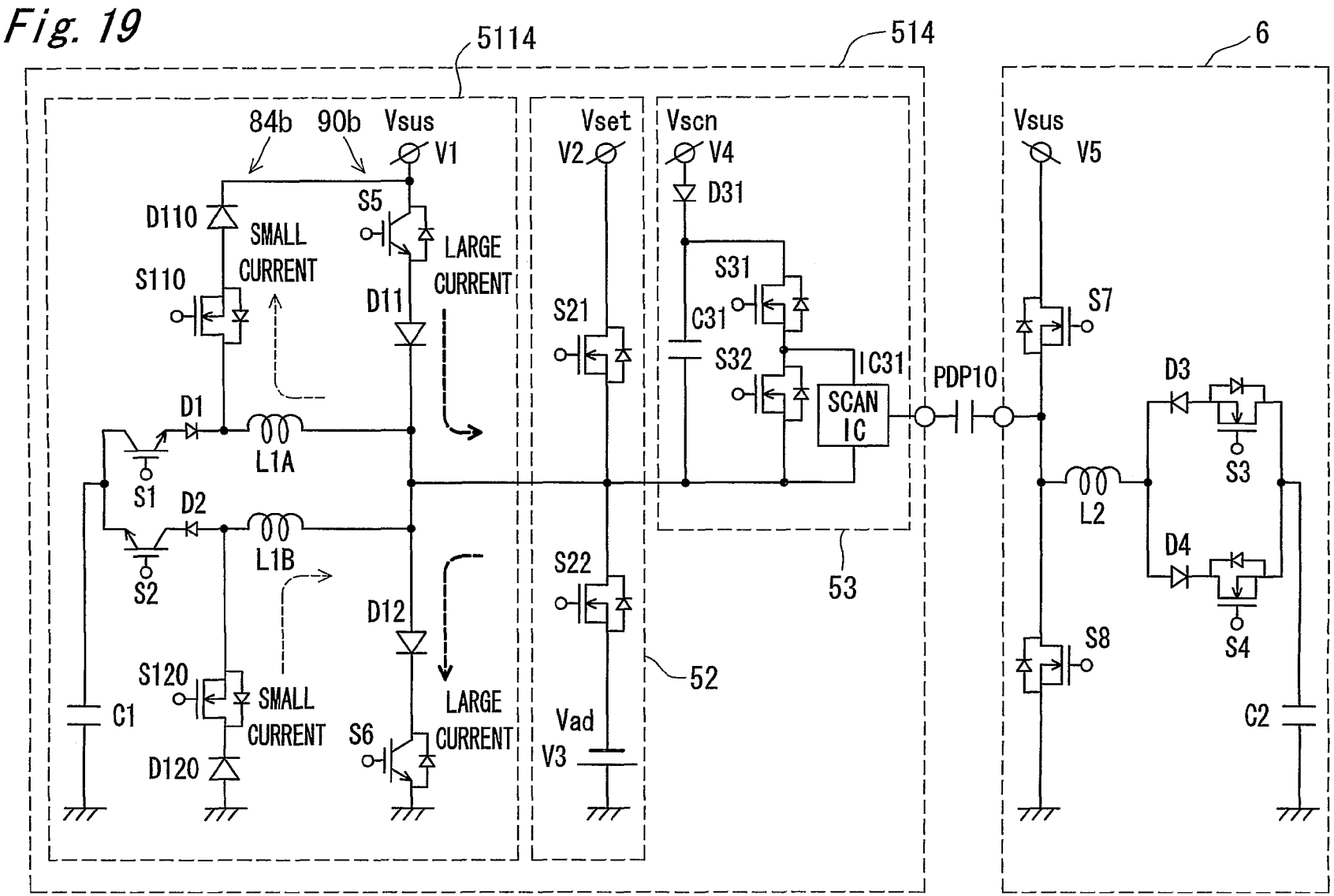
FIG. 19 is an illustration that indicates still another example of the PDP drive circuit configuration.

In the present embodiment, an example in which a coil for LC-resonance in the power recovery circuit is configured by the coil L1 only as shown in FIG. 13 through FIG. 18, but the present invention shall not be limited to this configuration only. For example, in order to change resonance frequency, etc. at the time of electric power recovery and at the reuse, two coils may be used for the power recovery circuit, under which the same effects can be obtained. FIG. 19 is an illustration that indicates still another example of the configuration of the PDP drive circuit in embodiment 2. What differs in configuration shown in FIG. 19 from the configuration shown in FIG. 13 is that two coils including the coil L1A and coil LIB, are used for the coil for LC-resonance in the power recovery circuit of the sustain pulse generation circuit 5114 in the scan electrode drive circuit 514, the coil L1B is used at the time of electric power recovery and the coil L1A is used at the time of reusing electric power. For example, even when the power recovery circuit is configured in this way, the same effects as described above can be obtained. In FIG. 19, a configuration in which the coil L1A of the power recovery circuit is connected to the cathode side of the diode D11 and the coil L1B is connected to the anode side of the diode D12 is shown. However, for example, a configuration in which the coil L1A is connected to the anode side of the diode D11 or the coil LIB is connected to the cathode side of the diode D12 may be adopted. In addition, in configurations shown in FIG. 14 through FIG. 18, too, the configuration of the power recovery circuits shown in FIG. 19 and FIGS. 20A and 20B may be adopted.

2-4-7 Modification Example 7

Figure 20A:
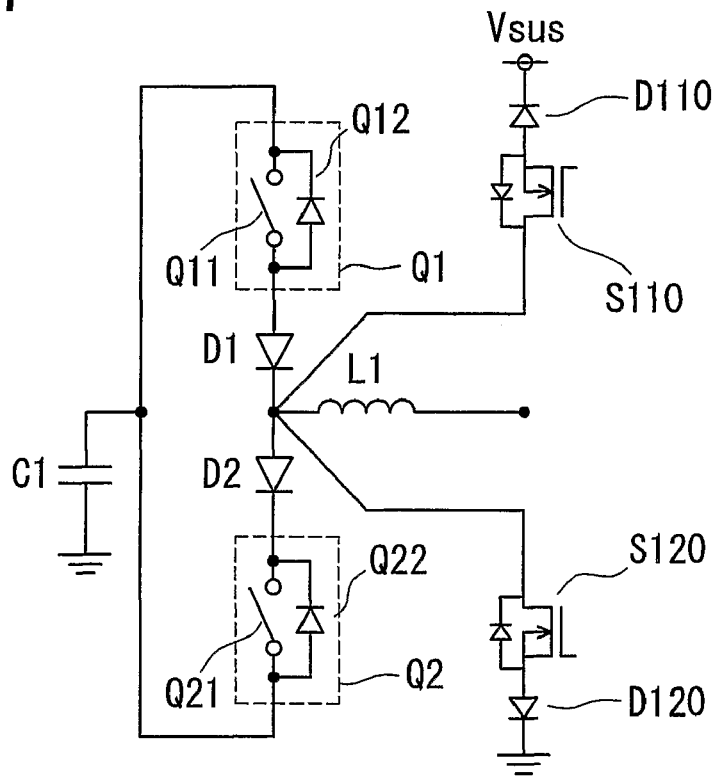
FIGS. 20A and 20B are illustrations that indicate other configuration examples of the power recovery circuit.
Figure 20B:
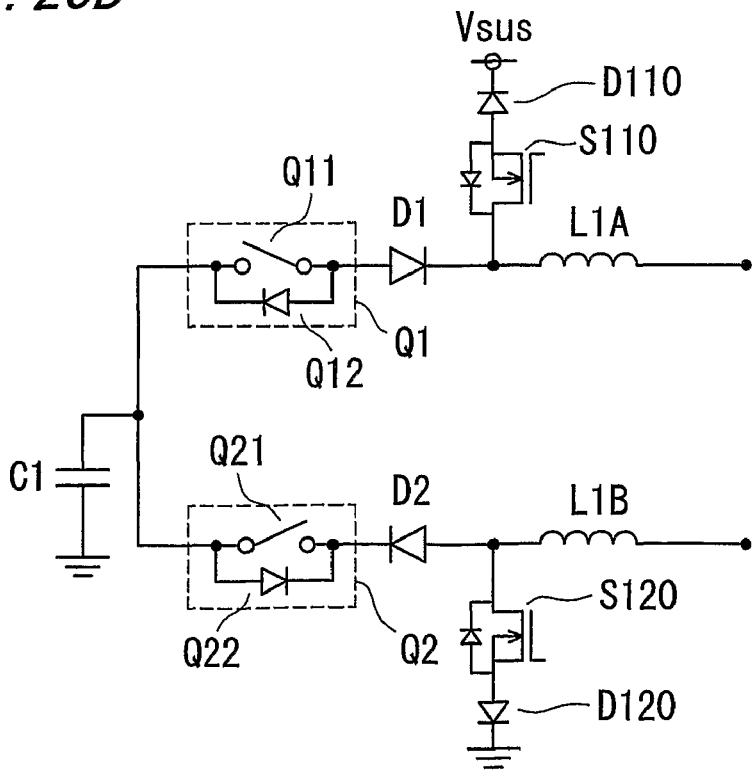

FIGS. 20A and 20B are figures that show another configuration examples of the power recovery circuit. The power recovery circuit shown in FIG. 20A has switching circuits Q1 and Q2 used in place of switching elements S1 and S2 in configurations of power recovery circuits of FIG. 13 through FIG. 18. The switching circuit Q1 is a parallel circuit of the switching element Q11 and diode Q12. The switching circuit Q2 is a parallel circuit of the switching element Q21 and diode Q22. The diode D1 and diode Q12 as well as the diode D2 and diode Q22 are back-to-back connected, respectively. Switching elements Q11 and Q21 are configured with MOSFET, IGBT, etc., and are properly selected in accord with specifications such as withstand voltage.

In addition, the power recovery circuit shown in FIG. 20B is a configuration in which two coils are used as is the case of FIG. 19. For the power recovery circuit shown in FIG. 20B, in the configuration of FIG. 19, switching circuits Q1 and Q2 composed of a parallel circuit of a switching element and a diode are used, respectively, in place of switching elements S1 and S2.

In FIGS. 20A and 20B, both series circuit of diode D110 and switching element S110 and series circuit of diode D120 and switching element S120 are shown. However, the series circuit of diode D110 and switching element S110 is required when the Vset separation switch is formed with diodes, while the series circuit of diode D120 and switching element S120 is required only when the Vad separation switch is formed with diodes. That is, as shown in FIG. 17, where the diode D12 is not provided as the Vad separation switch, in FIGS. 20A and 20B, the series circuit of diode D120 and switching element S120 is no longer required. In addition, as in the case of FIG. 18, where the diode D1 is not provided as the Vset separation switch, in FIGS. 20A and 20B, the series circuit of diode D110 and switching element S110 is no longer required.

In the drive waveform desired by PDP 10 in embodiment 1 and embodiment 2 of the present invention, when the potential of the address period is equal to and less than 0 (V) and the first potential of the sustain period is 0 (V) is shown. But it is needless to say that the switching elements S12 and S120, and diode D12 will not be required when the drive waveform desired by the PDP 10 is equal to or higher than 0 (V) and the first potential in the sustain period is 0 (V).

Embodiment 3

In the present embodiment and the following embodiments, various variations will be described with respect to connection position of sustain switches, separation switches, and power recovery circuits.

Figure 21A:
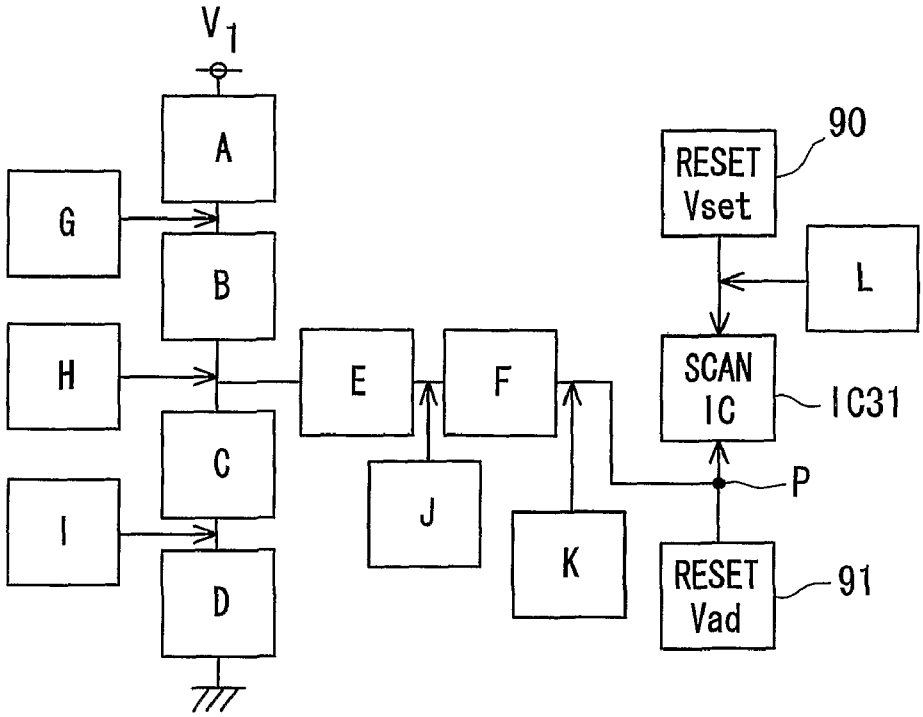
FIG. 21A is an illustration that indicates one example of circuit topology in the PDP drive circuit in embodiment 3 of the present invention.

FIG. 21A is an illustration that indicates one example of circuit topology in a PDP drive circuit. In the figure, a sustain switch, a separation switch, and a power recovery circuit are suitably disposed at either of blocks A through L, respectively. A block to which nothing is disposed is regarded as a simple connection node. In FIG. 21A, the circuit composed of the power supply V4, the diode D31, the capacitor 31, and switching elements S31 and S32 in the scan pulse generation circuit 53 shown in FIG. 1, etc. is omitted for convenience of explanation, but the circuit should be connected to the scan IC (IC31) in the connection relationship same as FIG. 1, etc. in FIG. 21A, too.

The sustain switch contains a high-side sustain switch disposed on the high voltage side and a low-side sustain switch disposed on the low-voltage side. The high-side sustain switch is a switch to supply the sustain voltage Vsus and corresponds to the switch S5 in the above-mentioned embodiments. The low-side sustain switch is a switch to supply ground potential and corresponds to the switch S6 in the above-mentioned embodiments.

The separation switch includes a Vset separation switch and a Vad separation switch. The Vset separation switch corresponds to the diode D11, switching element S10 or switching element S101. In particular, in the case of embodiment 1, a switching element 11 is connected to the diode D11 in parallel. The Vad separation switch corresponds to the diode D12, switching element S9 or switching element S102. In particular, in the case of embodiment 1, a switching element S12 is connected to the diode D12 in parallel.

The power recovery circuit includes a low-side power recovery circuit which recovers electric power from the PDP 10 to the recovery capacitor C1 and a high-side power recovery circuit which supplies the recovered electric power from recovery capacitor C1 to the PDP 10. These specific configurations are shown as per FIGS. 1, 10, 11, 13, 19, 20, etc.

For example, the low-side power recovery circuit corresponds to a circuit that includes the recovery capacitor C1, diode D2, switching element S2, and coil L1 in, for example, FIG. 1, etc. of embodiment 1. In FIG. 10, it corresponds to a circuit that includes the recovery capacitor C1, switch S2, diode D2, and coil L1B. In addition, in FIG. 13, etc. of embodiment 2, the low-side power recovery circuit corresponds to a circuit that includes the recovery capacitor C1, diode D2, switching element S2, and coil L1, as well as the diode D120 and switching element S120.

The high-side power recovery circuit corresponds to a circuit that includes the recovery capacitor C1, diode D1, switching element S1, and coil L1 in, for example, FIG. 1, etc. of embodiment 1. In addition, in FIG. 10, it corresponds to a circuit that includes the recovery capacitor C1, switch S1, diode D1, and coil L1A. In addition, in FIG. 13, etc. of embodiment 2, the high-side power recovery circuit corresponds to a circuit that includes the recovery capacitor C1, diode D1, switching element S1, and coil L1, as well as the diode D110 and switching element S110.

In FIG. 21A, a block 90 is a circuit block that supplies positive voltage Vsus in the reset period and corresponds to a circuit that includes the constant-voltage power supply V2 and switching element S21 in FIG. 1, etc. A block 91 is a circuit block that supplied negative voltage Vad in the reset period and corresponds to a circuit that includes the constant-voltage power supply V3 and switching element S22 in FIG. 1, etc.

Figure 21B:
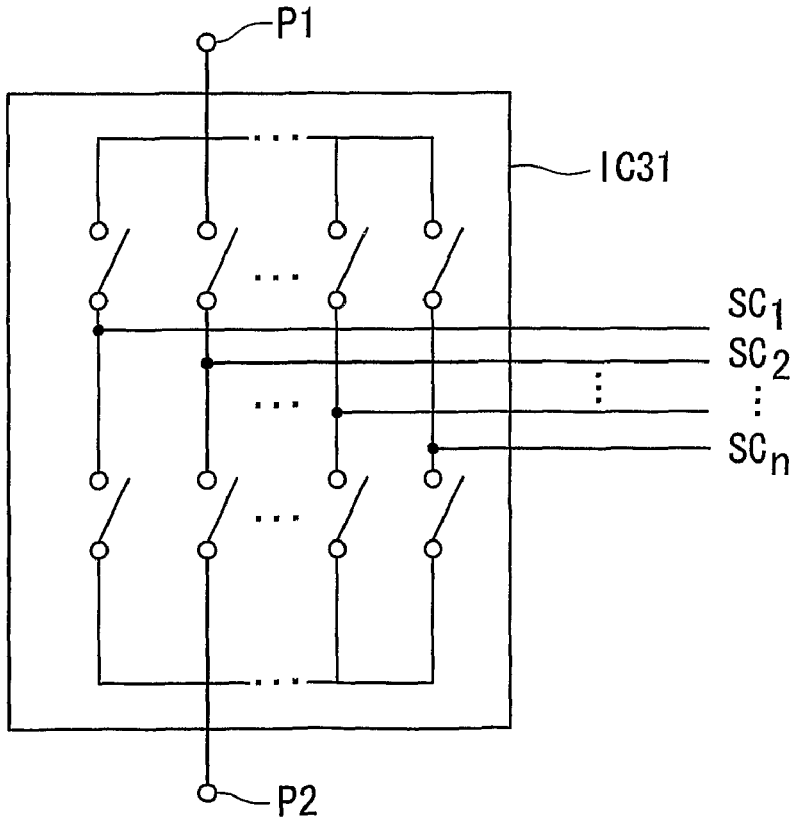
FIG. 21B is an illustration that indicates a configuration of scan IC.

A scan IC (IC31) has a configuration as shown in FIG. 21B, and is a circuit which has series circuits of high-voltage side switches and low-voltage side switches are connected in parallel in the number equivalent to that of scan electrodes. High-voltage side ends of high-voltage side switches are connected to the high-voltage side input terminal P1 in common. Low-voltage side ends of each low-voltage side switch are all connected to low-voltage-side input terminal P2 in common.

In the example of FIG. 21A, the high-voltage side input terminal P1 of the scan IC (IC31) is connected to the block 90 which supplies voltage Vsus and the low-voltage side input terminal P2 of the low-voltage side switch is connected to the block 91 that supplies voltage Vad. In addition, the output of the sustain pulse generation circuit is connected to the low-voltage side input terminal P2 of the scan IC (IC31). That is, during the sustain period, current is supplied to the PDP 10 via the low-voltage side input terminal P2 of scan IC (IC31) or current from the PDP 10 is drawn.

In the circuit topology as shown in FIG. 21A, variations with the following arrangements could be considered.

3-1 Pattern 1

In this pattern, a high-side sustain switch is arranged in block A, a low-side sustain switch is arranged in block D, a Vset separation switch is arranged in block B, and a Vad separation switch is arranged in block C, respectively. The high-side power recovery circuit is arranged to either one of blocks G, H, I, and L, and the low-side power recovery circuit is arranged in either one of blocks G, H, I, and L, too.

In the present pattern, the Vset separation circuit and the Vad separation circuit can be configured with diodes thereby resulting in an effect that the mounting area can be reduced.

3-2 Pattern 2

In this pattern, the high-side sustain switch is arranged in block A, the low-side sustain switch in block C, the Vset separation switch in block B, and the Vad separation switch in block D, respectively. The high-side power recovery circuit is arranged in either one of blocks G, H, and L, and the low-side power recovery circuit is arranged in either one of blocks G, H, and L, too.

In the present pattern, the Vset separation circuit and the Vad separation circuit can be configured with diodes, thereby resulting in an effect that the mounting area can be reduced.

3-3 Pattern 3

In this pattern, the high-side sustain switch is arranged in block B, the low-side sustain switch in block D, the Vset separation switch in block A, and the Vad separation switch in block F, respectively. Since in such event, the Vad separation switch is inserted in the main discharge path, the Vad separation switch is unable to be configured with a diode which allows the current to flow in one direction only. The Vad separation switch must be configured with a switching element, such as MOSFET, which allows the current to flow in bi-directions and can control the conduction.

The high-side power recovery circuit is arranged in any of blocks H, K, and L, and the low-side power recovery circuit is arranged in any of blocks H, K, and L.

In the present pattern, the Vset separation circuit can be configured with a diode.

3-4 Pattern 4

In this pattern, the high-side sustain switch is arranged in block B, the low-side sustain switch in block D, the Vset separation switch in block A, and the Vad separation switch in block C, respectively. The high-side power recovery circuit is arranged in either one of blocks H, I, and L, and the low-side power recovery circuit is arranged in either one of blocks H, I, and L, too.

In the present pattern, the Vset separation circuit and the Vad separation circuit can be configured with a diode, thereby resulting in an effect that the mounting area can be reduced.

3-5 Pattern 5

In this pattern, the high-side sustain switch is arranged in block B, the low-side sustain switch in block C, the Vset separation switch in block A, and the Vad separation switch in block D, respectively. The high-side power recovery circuit is arranged in either one of blocks H and L, and the low-side power recovery circuit is arranged in either one of blocks H or L, too.

In the present pattern, the Vset separation circuit and the Vad separation circuit can be configured with a diode thereby resulting in an effect that the mounting area can be reduced.

3-6 Pattern 6

In this pattern, the high-side sustain switch is arranged in block A, the low-side sustain switch in block D, the Vset separation switch in block E, and the Vad separation switch in block C, respectively. Since in such event, the Vset separation switch is inserted in the main discharge path, the Vset separation switch is unable to be configured with a diode which allows the current to flow in one direction only. It must be configured with a switching element, such as MOSFET, which allows current to flow in bi-directions and can control the conduction.

The high-side power recovery circuit is arranged in any of blocks H, I, J, and L, and the low-side power recovery circuit is arranged in any of blocks H, I, J, and L, too.

In the present pattern, the Vad separation circuit can be configured with a diode. The Vset separation circuit must be configured with a switching element.

3-7 Pattern 7

In this pattern, the high-side sustain switch is arranged in block A, the low-side sustain switch in block C, the Vset separation switch in block E, and the Vad separation switch in block D, respectively. Since in such event, the Vset separation switch may be inserted in the main discharge path, the Vset separation switch is unable to be configured with a diode which allows the current to flow in one direction only. It must be configured with a switching element, such as MOSFET, which allows the current to flow in bi-directions and can control the conduction.

The high-side power recovery circuit is arranged in any of blocks H, J, and L, and the low-side power recovery circuit is arranged in any of blocks H, J, and L, too.

In the present pattern, the Vad separation circuit can be configured with diodes. The Vset separation circuit must be configured with a switching element.

3-8 Pattern 8

In this pattern, the high-side sustain switch is arranged in block A, the low-side sustain switch in block D, the Vset separation switch in block B, and the Vad separation switch in block F, respectively. Since in such event, the Vad separation switch is inserted in the main discharge path, the Vad separation switch is unable to be configured with a diode which allows the current to flow in one direction only. It must be configured with a switching element, such as MOSFET, which allows the current to flow in bi-directions and can control the conduction.

The high-side power recovery circuit is arranged in any of blocks G, H, K, and L, and the low-side power recovery circuit is arranged in any of blocks G, H, K and L, too. In the present pattern, the Vset separation circuit can be configured with a diode. The Vad separation circuit must be configured with a switching element.

As one example of the pattern, the switching element S5 is arranged in block A, diode D11 and the switching element S11 connected to it in parallel in block B, a switching element S6 in block D, a switching element S9 in block F, the high-side power recovery circuit in block G, and the low-side power recovery circuit in block H.

3-9 Effects

Even when the positive peak voltage Vset of the reset period is applied to PDP 10 in the pattern 1 through pattern 8, voltage applied to the Vset separation switch rises upto the voltage obtained by subtracting address voltage (Vscn) from voltage Vset at most, and thus the withstand voltage of the separation switch can be reduced. In addition, since the discharge current does not flow in either the Vset separation circuit or the Vad separation circuit, circuit loss can be reduced.

In addition, in FIG. 21A, the block 90 that supplies voltage Vsus is connected to the high-voltage side input end of scan IC (IC31). However, similar to the block 91 which supplies voltage Vad, it may be connected to the low-voltage side input end of the scan IC (IC31) (in such event, the configuration of FIG. 1, etc. is obtained). In such event, of the above-mentioned combinations, the combination in which the power recovery circuit is disposed to block L is eliminated.

In the above-mentioned patters 1 through 8, the following effects are obtained in accordance with the location of the power recovery circuit. By disposing the power recovery circuit in blocks G or I, withstand voltage of the diode of the high side power recovery circuit or the switch of the low side power recovery circuit can be lowered. In addition, by disposing the power recovery circuit to block H, K or L, the recovery current does not pass the separation circuit, and consequently, loss in separation circuit loss can be reduced and as a result, the recovery efficiency can be improved.

In short, when the separation circuit is not disposed between a block to which the power recovery circuit is disposed and the PDP 10 (for example, when the power recovery circuit is disposed in block K or L), the recovered current does not pass the separation circuit, and consequently, loss in separation circuit can be reduced, and as a result, the recovery efficiency can be improved (this effect is called the "current advantage"). In addition, when the block in which the power recovery circuit is arranged is disposed on the PDP side with respect to the block in which the separation circuit is disposed (for example, when the power recovery circuit is disposed at block G, H, or I), the electric power recover circuit is applied with the sustain voltage Vsus at a maximum, and thus the withstand voltage of a diode or a switch contained in the power recovery circuit can be reduced (this effect is called the "voltage advantage"). The foregoing points are the same in the following embodiments. For example, the optimum drive conditions require high initialization voltages (Vset, Vad), a configuration with priority given to the voltage advantage is suited. When the panel capacity is large and the electric power to be recovered is high (recovery current is large) and/or when time allowed for recovery is short (when a recovery circuit is large), a configuration with priority given to the current advantage is suited. The size of the recovery current depends on the product among sustain voltage, panel capacity, and inverse of rise or fall time of sustain voltage.

Embodiment 4

Figure 22:
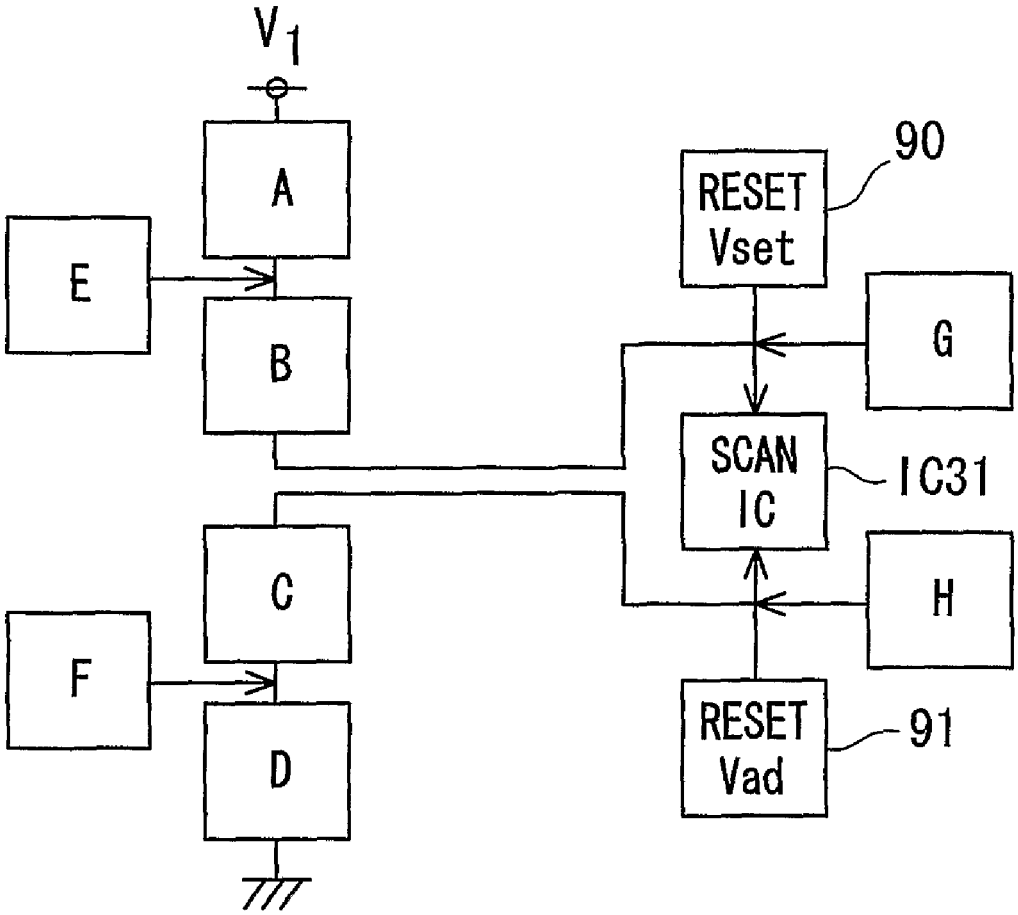
FIG. 22 is an illustration that indicates one example of circuit topology in the PDP drive circuit in embodiment 4 of the present invention.

FIG. 22 is an illustration that indicates another example of circuit topology in the PDP drive circuit.

In the example of FIG. 22, the high-voltage side input terminal P1 of the scan IC (IC31) is connected to block 90 which supplies voltage Vsus and the low-voltage side input terminal P2 of the low-voltage side switch is connected to block 91 that supplies voltage Vad. In addition, the high-voltage side output (Vsus) of the sustain pulse generation circuit is connected to the high-voltage side input terminal P1 of scan IC (IC31) and the low-voltage side output (ground) is connected to the low-voltage side input terminal P2. That is, during the sustain period, current is supplied to the PDP 10 via the high-voltage side input terminal P1 of the scan IC (IC31) and current from the PDP 10 is swept via the low-voltage side input terminal P2.

In the circuit topology as shown in FIG. 22, variations with the following arrangements could be considered.

4-1 Pattern 1

In this pattern, a high-side sustain switch is arranged in block A, a low-side sustain switch is arranged in block D, a Vset separation switch is arranged in block B, and a Vad separation switch is arranged in block C, respectively. The high-side power recovery circuit is arranged in either one of blocks E, F, G or H, and the low-side power recovery circuit is arranged to either one of blocks E, F, G or H, too.

4-2 Pattern 2

In this pattern, the high-side sustain switch is arranged in block B, the low-side sustain switch in block D, the Vset separation switch to block A, and the Vad separation switch in block C, respectively. The high-side power recovery circuit is arranged in either one of blocks F, G, or H, and the low-side power recovery circuit is arranged in either one of blocks F, G, or H, too.

4-3 Pattern 3

In this pattern, the high-side sustain switch is arranged in block A, the low-side sustain switch in block C, the Vset separation switch in block B, and the Vad separation switch in block D, respectively. The high-side power recovery circuit is arranged in any of blocks E, G, and H, and the low-side power recovery circuit is arranged in any of blocks E, G, and H, too.

4-4 Pattern 4

In this pattern, the high-side sustain switch is arranged in block B, the low-side sustain switch in block C, the Vset separation switch in block A, and the Vad separation switch in block D, respectively. The high-side power recovery circuit is arranged in block G or H, and the low-side power recovery circuit is arranged in block G or H.

In the above-mentioned patterns 1 through 4, the Vset separation circuit and the Vad separation circuit can be configured with a diode thereby resulting in an effect that the packaging area can be reduced. In addition, since the discharge current does not flow in either the Vset separation circuit nor the Vad separation circuit, circuit loss can be reduced.

Embodiment 5

Figure 23:
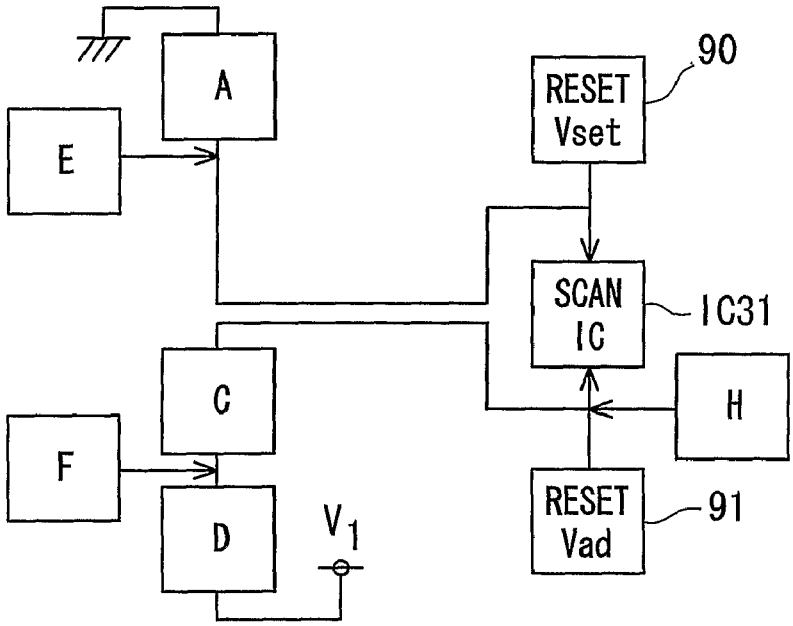
FIG. 23 is an illustration that indicates one example of circuit topology in the PDP drive circuit in embodiment 5 of the present invention.

FIG. 23 is an illustration that indicates another example of circuit topology in the PDP drive circuit. In the example of FIG. 23, the high-voltage side input terminal P1 of the scan IC (IC31) is connected to block 90 which supplies voltage Vset and the low-voltage side input terminal P2 of the low-voltage side switch is connected to block 91 that supplies voltage Vad. In addition, the high-voltage side output (Vsus) of the sustain pulse generation circuit is connected to the low-voltage side input terminal P2 of the scan IC (IC31) and the low-voltage side output (ground) is connected to the high-voltage side input terminal P1. That is, during the sustain period, current is supplied to the PDP 10 via the low-voltage side input terminal P2 of scan IC (IC31) and current from the PDP 10 is swept via the high-voltage side input terminal P1.

In the circuit topology as shown in FIG. 23, variations with the following arrangements could be considered.

5-1 Pattern 1

In this pattern, a high-side sustain switch is arranged in block D, a low-side sustain switch is arranged in block A, and a Vset separation switch is arranged in block C, respectively. No Vad separation circuit is disposed. The high-side power recovery circuit is arranged in either one of blocks E, F, or H and the low-side power recovery circuit is arranged in either one of blocks E, F, or H, too.

5-2 Pattern 2

The high-side sustain switch is arranged in block C, the low-side sustain switch in block A, and the Vset separation switch in block D, respectively. No Vad separation circuit is disposed. The high-side power recovery circuit is arranged in either one of blocks E or H, and the low-side power recovery circuit is arranged to either one of blocks E or H, too.

Because in the above patterns 1 and 2, the drain voltage of the low-side sustain switch is kept positive even when the negative peak voltage Vad is applied during the reset period, no Vad separation circuit is required. In such event, the high-side switch of scan IC serves a function of the separation switch. However, this is effective to a case where voltage V4 which is used for selecting discharge of the scan IC (on address operation) is larger than voltage Vad.

Embodiment 6

Figure 24:
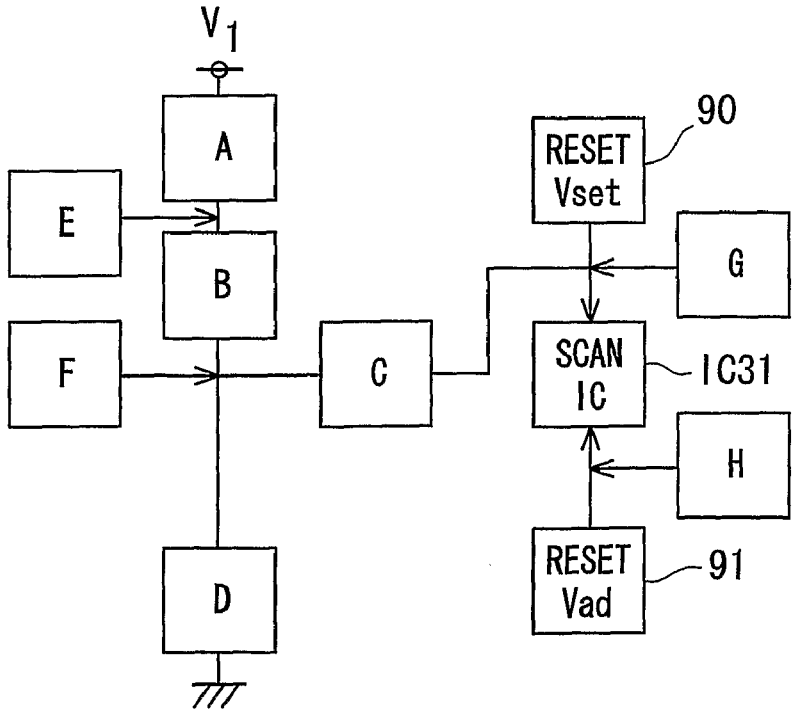
FIG. 24 is an illustration that indicates one example of circuit topology in the PDP drive circuit in embodiment 6 of the present invention.
Figure 25:
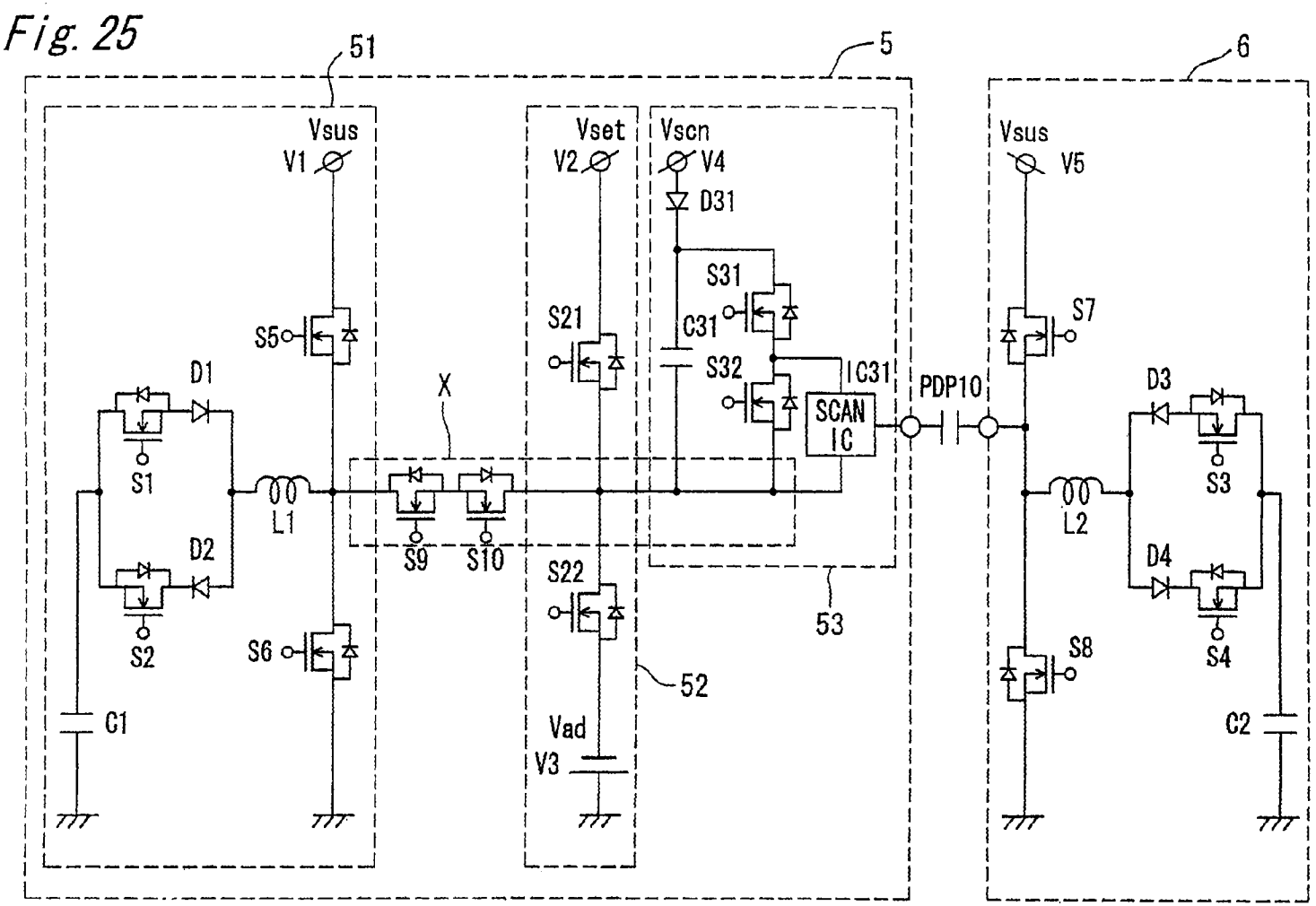
Fig. 25 PRIOR ART
FIG. 25 is a circuit diagram of a scan drive circuit and a sustain electrode drive circuit equipped with a power recovery circuit.
Figure 26:
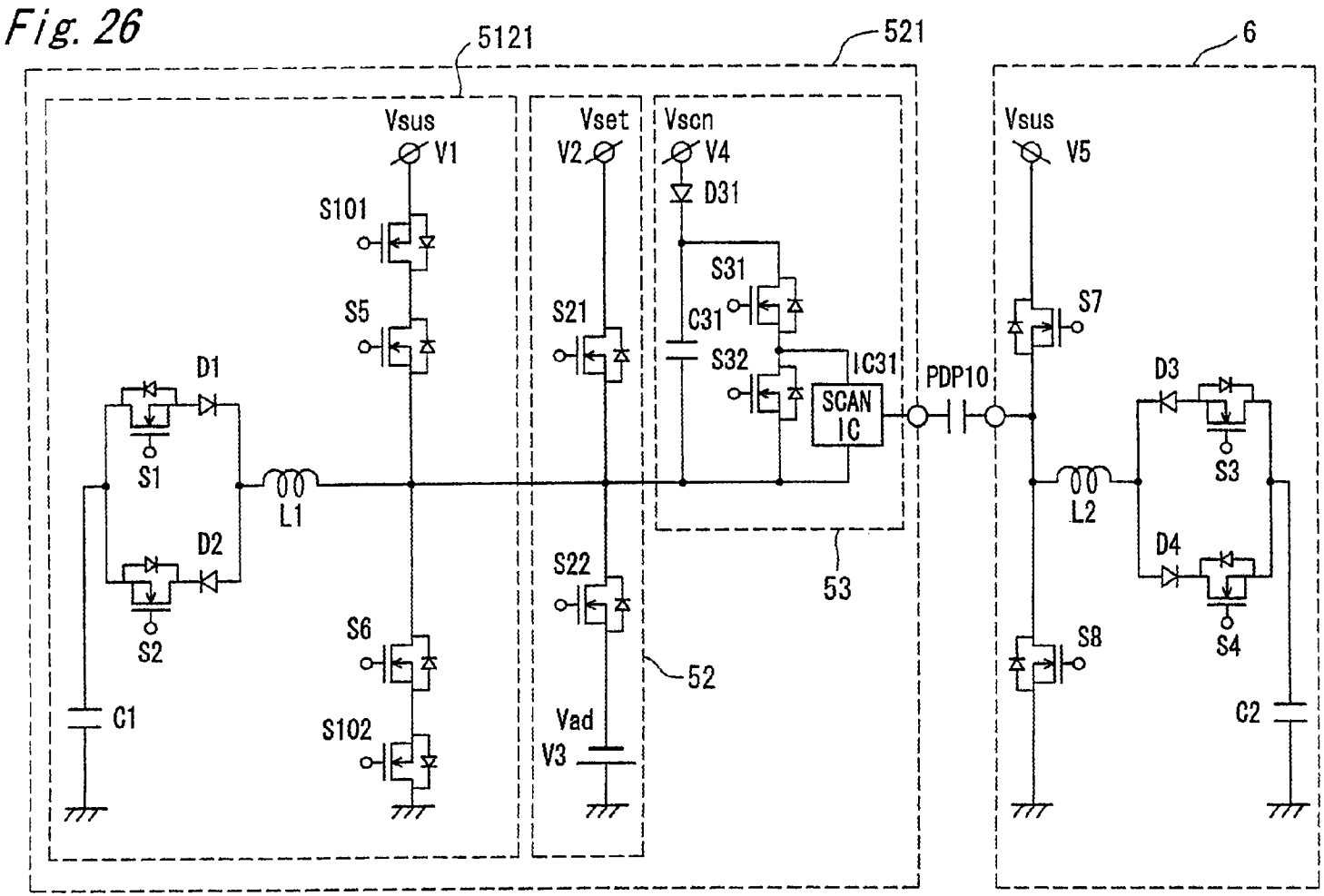
Fig. 26 PRIOR ART
FIG. 26 is a circuit diagram of a scan electrode drive circuit with switching elements equipped to a voltage clamp circuit of a sustain pulse generation circuit, and a sustain electrode drive circuit.

FIG. 24 is an illustration that indicates another example of circuit topology in the PDP drive circuit.

In the example of FIG. 24, the high-voltage side input terminal P1 of the scan IC (IC31) is connected to block 90 which supplies voltage Vsus and the low-voltage side input terminal P2 of the low-voltage side switch is connected to block 91 that supplies voltage Vad. In addition, the output of the sustain pulse generation circuit is connected to the high-voltage side input terminal P1 of the scan IC (IC31). That is, during the sustain period, current is supplied to the PDP 10 or current from the PDP 10 is drawn, via the high-voltage side input terminal P1 of the scan IC (IC31).

In the circuit topology as shown in FIG. 24, variations with the following arrangements could be considered.

6-1 Pattern 1

A high-side sustain switch is arranged in block A, a low-side sustain switch is arranged in block D, and a Vset separation switch is arranged in block B, respectively. No Vad separation circuit is disposed. The high-side power recovery circuit is arranged in either one of blocks E, F, or H and the low-side power recovery circuit is arranged in either one of blocks E, F, and H, too.

6-2 Pattern 2

In this pattern, the high-side sustain switch is arranged in block B, the low-side sustain switch in block D, and the Vset separation switch in block A, respectively. No Vad separation circuit is disposed. The high-side power recovery circuit is arranged in either one of blocks F and H and at the same time, the low-side power recovery circuit is arranged in either one of blocks F and H, too.

Because in the above patterns 1 and 2, the drain voltage of the low-side sustain switch is kept positive even when the negative peak voltage Vad is applied during the reset period, no Vad separation circuit is required. In such event, the high-side switch of the scan IC serves a function of the separation switch.

The present invention has been described on specific embodiments, but for those skilled in the art, other many modification examples, corrections, and other uses are apparent. Consequently, it is to be understood that the invention is not limited to the specific disclosures herein except as defined in the appended claims.

The present application is related to Japanese Patent Application No. 2005-149045 (filed on May 23, 2005), of which content is incorporated herein by reference.

INDUSTRIAL APPLICABILITY

The present invention is useful to a PDP drive circuit and a plasma display apparatus including an electric recovery circuit and capable of reducing invalid power consumption by reducing impedance in the main discharge path, and particularly to those capable of reducing the number of elements that compose the drive circuit to reduce the mounting area and generating drive waveforms with little strain.

The invention claimed is:

1. A plasma display panel drive circuit for driving a plasma display panel having a plurality of scan electrodes and sustain electrodes, comprising:

a pulse voltage generator that includes a main switching element disposed on a high voltage side and a main switching element disposed on a low voltage side, and is operable to generate a pulse voltage by operating the main switching elements in accordance with an output voltage from a first power supply, and apply the pulse voltage to the plurality of scan electrodes and/or sustain electrodes of the plasma display panel; and a reset voltage generator operable to generate a reset voltage in accordance with an output voltage from a second power supply that outputs a voltage higher than the output voltage of the first power supply, and apply the reset voltage to the plasma display panel, wherein the pulse voltage generator includes a first diode operable to prevent the voltage output by the reset voltage generator from being applied in a reverse direction to the first power supply and a first switching element connected to the first diode in parallel, the first switching element includes a body diode, the first diode has a larger maximum rated value than the body diode of the first switching element, the high voltage side main switching element includes a body diode, and the first switching element is connected to the high voltage side main switching element such that a forward bias direction of the body diode of the first switching element is opposite to a forward bias direction of the body diode of the high voltage side main switching element.

2. The plasma display panel drive circuit according to claim 1, wherein the high voltage side main switching element is disposed on an anode side of the first diode.

3. The plasma display panel drive circuit according to claim 1, wherein the high voltage side main switching element is disposed on a cathode side of the first diode.

4. A plasma display apparatus, comprising:

a plasma display panel having a plurality of scan electrodes and sustain electrodes; and the plasma display panel drive circuit according to claim 1 operable to drive the plasma display panel.

5. A plasma display panel drive circuit for driving a plasma display panel that has a plurality of scan electrodes and sustain electrodes, comprising:

a pulse voltage generator that includes a main switching element disposed on a high voltage side and a main switching element disposed on a low voltage side between a first power supply and a ground, and is operable to generate a pulse voltage by operating the main switching elements in accordance with an output voltage from the first power supply, and apply the pulse voltage to the plurality of scan electrodes and/or sustain electrodes of the plasma display panel;

a second reset voltage generator operable to generate a second reset voltage in accordance with an output voltage from a third power supply that outputs a voltage lower than the output voltage of the first power supply and apply the second reset voltage to the plasma display panel;

a second diode operable to prevent the second reset voltage output by the second reset voltage generator from being applied in a reverse direction to the first power supply; and a second switching element connected to the second diode in parallel, wherein the second switching element comprises a body diode, the second diode has a larger maximum rated value than the body diode of the second switching element, the low voltage side main switching element comprises a body diode, and the second switching element is connected to the low voltage side main switching element such that a forward bias direction of the body diode of the second switching element is opposite to a forward bias direction of the body diode of the low voltage side main switching element.

6. The plasma display panel drive circuit according to claim 5, wherein the low voltage side main switching element is disposed on a cathode side of the second diode.

7. The plasma display panel drive circuit according to claim 5, wherein the low voltage side main switching element is disposed on an anode side of the second diode.

8. A plasma display apparatus, comprising:

a plasma display panel having a plurality of scan electrodes and sustain electrodes; and the plasma display panel drive circuit according to claim 5 operable to drive the plasma display panel.

9. A plasma display panel drive circuit for driving a plasma display panel that has a plurality of scan electrodes and sustain electrodes, comprising:

a pulse voltage generator that includes a main switching element disposed on a high voltage side and a main switching element disposed on a low voltage side, and is operable to generate a pulse voltage by operating the main switching elements in accordance with an output voltage from a first power supply, and apply the pulse voltage to the plurality of scan electrodes and/or sustain electrodes of the plasma display panel;

a reset voltage generator operable to generate a reset voltage in accordance with an output voltage from a second power supply that outputs a voltage higher than the output voltage of the first power supply and apply the reset voltage to the plasma display panel;

a first diode operable to prevent the voltage output by the reset voltage generator from being applied in a reverse direction to the first power supply;

a first power recoverer operable to resonate with a capacitive load of the plasma display panel and recover electric power accumulated in the plasma display panel;

a second power recoverer operable to supply the recovered electric power to the plasma display panel;

a third diode that allows a current to flow into the first power supply while shutting off a current flowing from the first power supply to the scan electrode; and a third switching element that is connected to the third diode in series and is operable to control flowing and shutoff of a current to the first power supply, wherein the third switching element comprises a body diode, the first diode has a larger maximum rated value than body diode of the third switching element, the high voltage side main switching element comprises a body diode, the first diode is connected to the high voltage side main switching element in series such that a forward bias direction of the first diode is opposite to a forward bias direction of the body diode of the high voltage side main switching element, and the third diode is connected to the third switching element such that a forward bias direction of the third diode is opposite to a forward bias direction of the body diode of the third switching element.

10. The plasma display panel drive circuit according to claim 9, wherein the low voltage side main switching element is disposed on an anode side of the first diode.

11. The plasma display panel drive circuit according to claim 9, wherein the low voltage side main switching element is disposed on a cathode side of the first diode.

12. A plasma display apparatus, comprising:

a plasma display panel having a plurality of scan electrodes and sustain electrodes; and the plasma display panel drive circuit according to claim 9 operable to drive the plasma display panel.

13. The plasma display panel drive circuit according to claim 9, wherein the first diode and the high voltage side main switching element connected in series are connected in parallel to the third diode and the third switching element connected in series.

14. A plasma display panel drive circuit for driving a plasma display panel that has a plurality of scan electrodes and sustain electrodes, comprising:

a pulse voltage generator that contains a main switching element disposed on a high voltage side and a main switching element disposed on a low voltage side between a first power supply and a ground, and is operable to generate a pulse voltage by operating the main switching elements in accordance with an output voltage from the first power supply, and apply the pulse voltage to the plurality of scan electrodes and/or sustain electrodes of the plasma display panel; and a second reset voltage generator operable to generate a second reset voltage in accordance with an output voltage from a third power supply that outputs a voltage lower than the output voltage of the first power supply, and apply the second reset voltage to the plasma display panel;

a second diode operable to prevent the voltage output by the second reset voltage generator from being applied in a reverse direction to the first power supply;

a first power recoverer operable to resonate with a capacitive load of the plasma display panel and recover electric power accumulated in the plasma display panel;

a second power recoverer operable to supply the recovered electric power to the plasma display panel;

a fourth diode operable to shut off a current flowing from the first power supply to the ground; and a fourth switching element connected to the fourth diode in series, and operable to control flowing/shutoff of a current from the ground via the fourth diode;

wherein the fourth switching element comprises a body diode, the second diode has a larger maximum rated value than the body diode of the fourth switching element, the low voltage side switching element comprises a body diode, the second diode is connected to the low voltage side main switching element in series such that a forward bias direction of the second diode is opposite to a forward bias direction of the body diode of the low voltage side main switching element, and the fourth diode is connected to the fourth switching element such that a forward bias direction of the fourth diode is opposite to a forward bias direction of the body diode of the fourth switching element.

15. The plasma display panel drive circuit according to claim 14, wherein the low voltage side main switching element is disposed on a high-voltage side of the second diode.

16. The plasma display panel drive circuit according to claim 14, wherein the low voltage side main switching element is disposed on a low-voltage side of the second diode.

17. A plasma display apparatus, comprising:

a plasma display panel having a plurality of scan electrodes and sustain electrodes; and the plasma display panel drive circuit according to claim 14 operable to drive the plasma display panel.

18. The plasma display panel drive circuit according to claim 14, wherein the second diode and the low voltage side main switching element connected in series are connected in parallel to the fourth diode and the fourth switching element connected in series.

19. A plasma display panel drive circuit that includes a plurality of scan electrodes and sustain electrodes, comprising:

a pulse voltage generator that contains a high-side main switching element disposed on a high-voltage side and a low-side main switching element disposed on a low-voltage side between a first power supply and a ground, generates a pulse voltage by operating the main switching elements in accordance with an output voltage from the first power supply, and applies the pulse voltage to the plurality of scan electrodes and/or sustain electrodes on the plasma display panel;

a first reset voltage generator that generates a first reset voltage in accordance with an output voltage from a second power supply which-outputs a voltage higher than the output voltage of the first power supply, and applies the first reset voltage to the plasma display panel;

a second reset voltage generator operable to generate a second reset voltage in accordance with an output voltage from a third power supply which outputs the voltage lower than the output voltage of the first power supply, and to apply the second reset voltage to the plasma display panel;

a diode that is connected on the lower voltage side of the high-side main switching element and is operable to prevent a voltage output by the first reset voltage generator from being applied backward to the first power supply;

a first switching element that comprises a body diode and is connected in parallel to the diode, the diode having a larger maximum rated value than the body diode of the first switching element;

a fifth switching element disposed in a main discharge path, and operable to prevent a voltage output by the second reset voltage generator from being applied backward to a reference potential of the first power supply;

a first power recoverer operable to recover electric power accumulated in a capacitive load of the plasma display panel;

a second power recoverer operable to supply the recovered electric power to the plasma display panel; and a scanner operable to select a scanning electrode for applying a voltage for address discharge, and has input terminals on the high-voltage side and on the low-voltage side, wherein the second power recoverer is connected to a node connecting the high-side main switching element and the diode, the first power recoverer is connected to a terminal of the diode which is not connected to the high-side main switching element, the first reset voltage generator is connected to the high voltage side of the scanner, and the second reset voltage generator is connected to the low voltage side of the scanner, the high-side main switching element comprises a body diode, the first switching element is connected to the high-side main switching element such that a forward bias direction of the body diode of the first switching element is opposite to a forward bias direction of the body diode of the high-side main switching element, and the diode is connected to the high-side main switching element such that a forward bias direction of the diode is opposite to a forward bias direction of the body diode of the high-side main switching element.

20. A plasma display apparatus, comprising:

a plasma display panel having a plurality of scan electrodes and sustain electrodes; and the plasma display panel drive circuit according to claim 19 operable to drive the plasma display panel.

* * * * *